US008208846B2

(12) United States Patent
Takemoto et al.

(10) Patent No.: US 8,208,846 B2
(45) Date of Patent: Jun. 26, 2012

(54) IMAGE FORMING APPARATUS HAVING A LOCKING MECHANISM FOR PREVENTING A CONVEYANCE UNIT FROM BEING PULLED OUT FROM THE IMAGE FORMING APPARATUS

(75) Inventors: Mitsutoshi Takemoto, Osaka (JP); Kotaro Kawasaki, Osaka (JP)

(73) Assignee: Kyocera Mita Corporation (JP)

( * ) Notice: Subject to any disclaimer, the term of this patent is extended or adjusted under 35 U.S.C. 154(b) by 818 days.

(21) Appl. No.: 12/036,464

(22) Filed: Feb. 25, 2008

(65) Prior Publication Data

US 2008/0205953 A1 Aug. 28, 2008

(30) Foreign Application Priority Data

Feb. 28, 2007 (JP) ..... 2007-049050
May 31, 2007 (JP) ..... 2007-144958

(51) Int. Cl.
*G03G 15/00* (2006.01)

(52) U.S. Cl. ..... 399/397; 399/401; 400/691; 400/692

(58) Field of Classification Search ..... 399/397; 400/691, 692
See application file for complete search history.

(56) References Cited

U.S. PATENT DOCUMENTS

| | | | | |
|---|---|---|---|---|
| 7,221,887 | B2 * | 5/2007 | Kimura et al. | 399/101 |
| 7,409,175 | B2 * | 8/2008 | Kim et al. | 399/107 |
| 2002/0085857 | A1 * | 7/2002 | Kim et al. | 399/119 |
| 2005/0244189 | A1 * | 11/2005 | Kimura et al. | 399/121 |

FOREIGN PATENT DOCUMENTS

| | | |
|---|---|---|
| JP | 8-2704 | 1/1996 |
| JP | 2003137453 | 5/2003 |
| JP | 2005141024 | 6/2005 |
| JP | 200664727 | 3/2006 |

* cited by examiner

*Primary Examiner* — Matthew G Marini
(74) *Attorney, Agent, or Firm* — Gerald E. Hespos; Michael J. Porco

(57) ABSTRACT

An image forming apparatus is provided with an apparatus main body, an image forming assembly arranged in the apparatus main body, a sheet tray on which a sheet is to be placed, a conveyance unit detachably insertable into the apparatus main body, provided between the sheet tray and the image forming assembly and adapted to convey the sheet on the sheet tray toward the image forming assembly, an openable and closable cover member provided on a wall of the apparatus main body facing a downstream end of the conveyance unit in a sheet conveying direction, a vertical conveyance path defined at an inner side of the cover member by closing the cover member for further conveying the sheet conveyed by the conveyance unit upward, and a locking mechanism for preventing the conveyance unit from being pulled out from the apparatus main body with the cover member closed.

17 Claims, 11 Drawing Sheets

IMAGE FORMING APPARATUS HAVING A LOCKING MECHANISM FOR PREVENTING A CONVEYANCE UNIT FROM BEING PULLED OUT FROM THE IMAGE FORMING APPARATUS

BACKGROUND OF THE INVENTION

1. Field of the Invention

The present invention relates to an image forming apparatus for forming an image based on image information and particularly to an image forming apparatus capable of quickly and properly performing a jam removal processing.

2. Description of the Related Art

Sheet conveyance paths for conveying sheets for various purposes are provided, for example, in an image forming apparatus such as a copier, a facsimile machine or a printer. These sheet conveyance paths, for example, include a conveyance path for introducing a sheet from a sheet cassette for storing sheets to an image forming assembly, a conveyance path for introducing a manually inserted sheet from a manual feed tray to the image forming assembly, a conveyance path for introducing a sheet from the image forming assembly to a discharge tray via a fixing device, and a conveyance path for introducing a sheet having one side printed to the image forming assembly after the sheet is turned upside down in the case of duplex printing.

There are a great number of image forming apparatuses in which some of such sheet conveyance paths are unitized (conveyance unit) and this conveyance unit is detachably mountable into an apparatus main body. In such an image forming apparatus, a sheet jam sometimes occurs with a jammed sheet present between the detachable conveyance unit and the sheet conveyance path fixedly arranged in the apparatus main body. If a user pulls the conveyance unit out in this state, the sheet is broken and it takes time and labor to deal with a succeeding jam processing. Normally, such a jam processing procedure as not to cause this situation is prepared, but it actually frequently happens that users accidentally pull the conveyance unit without noticing such a processing.

Japanese Unexamined Patent Publication No. H08-2704 discloses an image forming apparatus constructed such that a grip used to pull the conveyance unit out cannot be held by a user unless a cover member constituting one side of a sheet conveyance path is opened, thereby prohibiting the conveyance unit from being inadvertently pulled out.

However, the method disclosed in Japanese Unexamined Patent Publication No. H08-2704 requires an electrical part such as a plunger or sensor to prohibit the grip from being held, which disadvantageously complicates the construction.

SUMMARY OF THE INVENTION

An object of the present invention is to provide an image forming apparatus including a conveyance unit detachably mountable into an apparatus main body and capable of invariably letting a user strictly enforce a jam processing in a suitable procedure.

In order to accomplish the above object, one aspect of the present invention is directed to an image forming apparatus, comprising an apparatus main body; an image forming assembly arranged in the apparatus main body for transferring a toner image formed based on image information to a sheet; a sheet tray on which a sheet to be subjected to an image transfer process is to be placed; a conveyance unit detachably insertable into the apparatus main body, provided between the sheet tray and the image forming assembly and adapted to convey the sheet on the sheet tray toward the image forming assembly; an openable and closable cover member provided on a wall of the apparatus main body facing a downstream end of the conveyance unit in a sheet conveying direction; a vertical conveyance path defined at an inner side of the cover member by closing the cover member for further conveying the sheet conveyed by the conveyance unit upward; and a locking mechanism for preventing the conveyance unit from being pulled out from the apparatus main body with the cover member closed.

These and other objects, features, aspects and advantages of the present invention will become more apparent upon a reading of the following detailed description and accompanying drawings.

BRIEF DESCRIPTION OF THE DRAWINGS

FIGS. 7A and 7B are diagrams showing the function of the locking mechanism, wherein FIG. 7A shows a state where a cover member is set at a closing position and FIG. 7B shows a state where the cover member is set at an opening position.

DETAILED DESCRIPTION OF THE PREFERRED EMBODIMENTS

Figure 1:
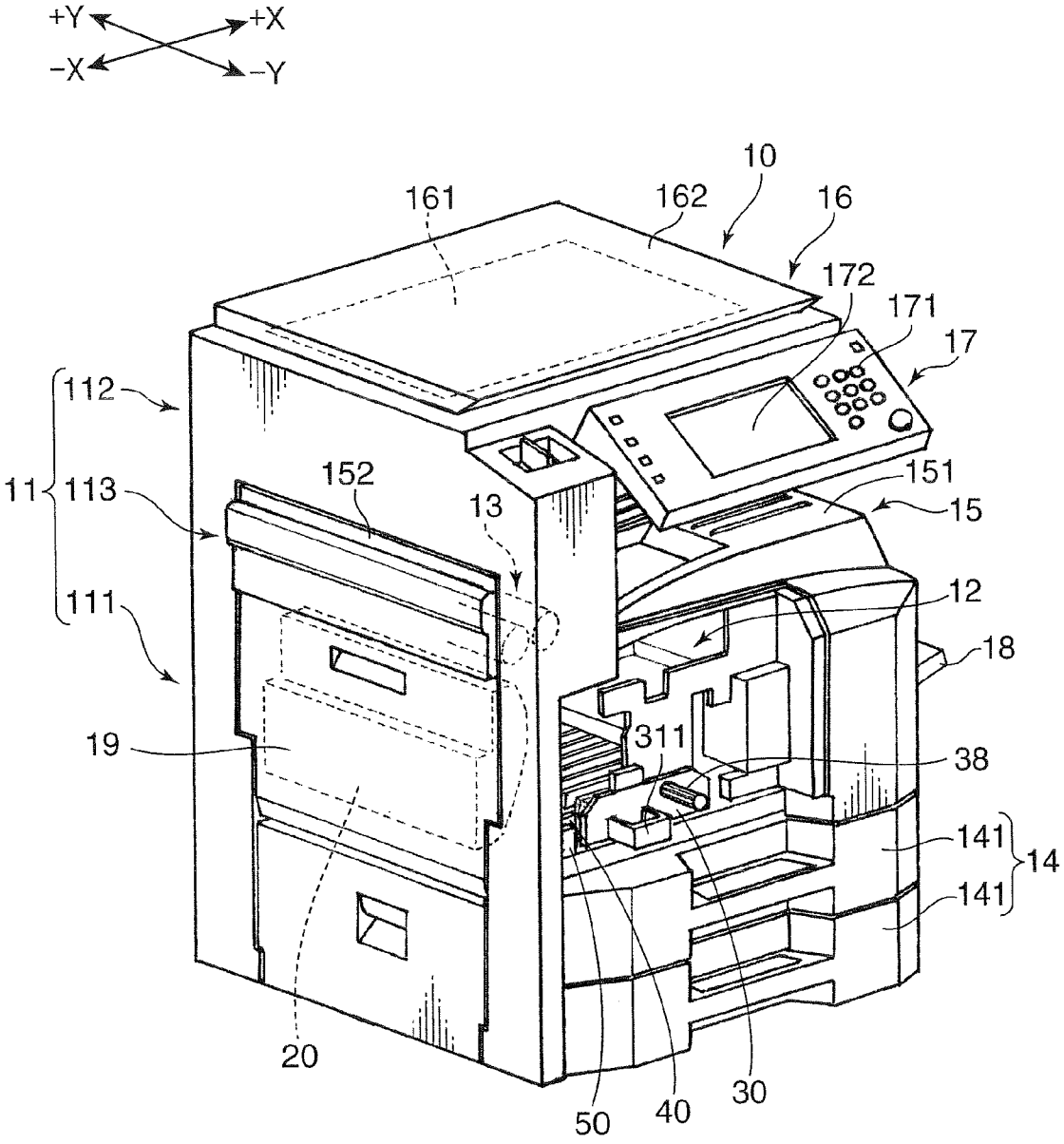
FIG. 1 is a perspective view of one embodiment of an image forming apparatus according to the present invention showing a state where a front cover is detached.
Figure 2:
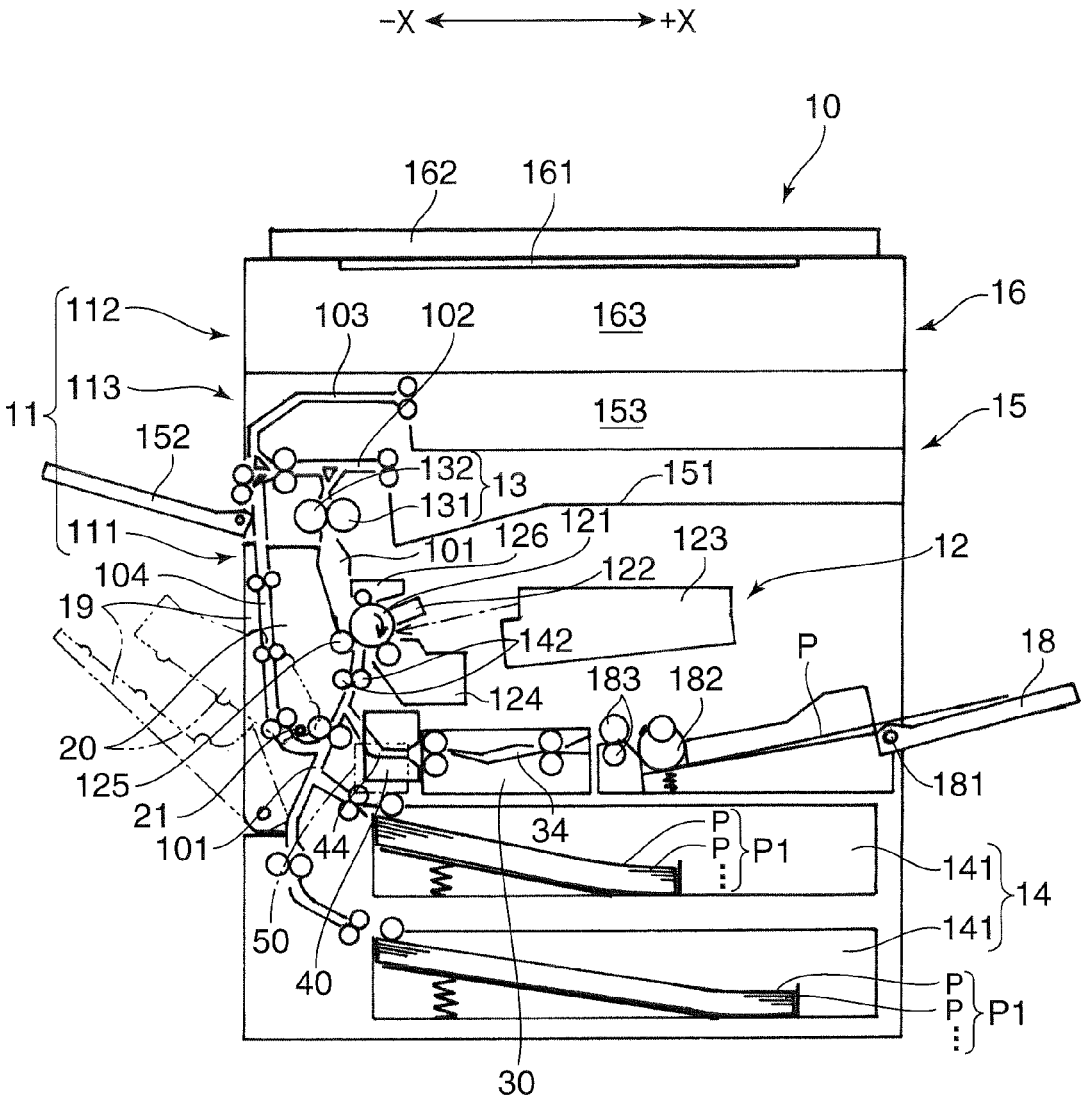
FIG. 2 is a front view in section showing the internal construction of the image forming apparatus.

FIG. 1 is a perspective view of an image forming apparatus 10 according to one embodiment of the present invention showing a state where a front cover is detached, and FIG. 2 is a front view in section showing the internal construction of the image forming apparatus. It should be noted that X-X directions are referred to as transverse directions and Y-Y directions to forward and backward directions in FIGS. 1 and 2, wherein, particularly, −X direction is a leftward direction, +X direction a rightward direction, −Y direction a forward direction and +Y direction a backward direction.

The image forming apparatus 10 is a copier of the so-called internal discharge type, and an apparatus main body 11 is provided with an image forming assembly 12, a fixing device 13, a sheet storing section 14, a discharging portion 15, an image reader 16 and an operation unit 17. The discharging portion 15 is formed by recessing a part of the apparatus main body 11 below the image reader 16.

The apparatus main body 11 includes a lower main body 111 having a rectangular parallelepipedic outer shape, an upper main body 112 opposed to the lower main body 111 from above and having a flat rectangular parallelepipedic shape, and a connecting part 113 interposed between the upper and lower main bodies 112, 111. The connecting part 113 is a structure for connecting the lower and upper main bodies 111, 112 to each other with the discharging portion 15 formed between the lower main body 111 and the upper main body 112. The upper main body 112 has a left side thereof supported on the upper end of the connecting part 113.

The lower main body 111 houses the image forming assembly 12, the fixing device 13 and the sheet storing section 14. The image reader 16 is mounted in the upper main body 112. The operation unit 17 projects forward from the front edge of the upper main body 112 in this embodiment.

The sheet storing section 14 includes sheet cassettes 141 detachably insertable into the apparatus main body 11. A sheet stack P1 (see FIG. 2) is stored in each sheet cassette 141. Upon performing an image forming operation, sheets P are dispensed one by one from this sheet stack P1 and fed to the image forming assembly 12 to be printed. In this embodiment, the sheet cassettes 141 are arranged in two levels.

The discharging portion 15 is formed between the lower main body 111 and the upper main body 112 and includes an internal discharge tray 151 formed on the upper surface of the lower main body 111. A sheet P having a toner image transferred thereto in the image forming assembly 12 is discharged onto this internal discharge tray 151 from the right wall of the connecting part 113.

The image reader 16 includes a contact glass 161, which is mounted on an opening formed in the upper surface of the upper main body 112 and on which a document is to be placed, a document pressing cover 162 openable and closable to press a document placed on the contact glass 161, and a scanning mechanism 163 for optically scanning an image of the document placed on the contact glass 161. Analog information of the document image read by the scanning mechanism 163 is outputted to an exposure unit 123 to be described later for an image forming operation after being converted into a digital signal.

The operation unit 17 is used to input process information on the image forming operation and includes a numeric keypad 171 and various other operation keys used to input the number of sheets P to be processed, an LCD (Liquid Crystal Display) 172 for the touch input, and the like.

A manual feed tray (sheet tray: sheet feeder) 18 is provided at a position right above the sheet storing section 14 on the right surface of the lower main body 111. The manual feed tray 18 has the bottom thereof supported rotatably about a supporting shaft 181 and is displaceable between a closing position where the manual feed tray 18 stands to close a manual feed opening and an opening position where the manual feed tray 18 projects to right. The manual feed tray 18 is used to manually feed sheets P one by one while being set at the opening position.

A conveyance unit 30 and an intermediate unit 40 that serve as a conveyance path for sheets P are provided between the manual feed tray 18 and a later-described photoconductive drum 121 of the image forming assembly 12. A sheet P (see FIG. 2) manually fed from the manual feed tray 18 is fed toward a nip portion between the photoconductive drum 121 and a transfer roller 125 to be described later via these conveyance unit 30 and intermediate unit 40.

An openable and closable maintenance door 19 (decorative door) is provided on the left surface of the lower main body 111. An openable and closable external discharge tray 152 is provided at a position right above this maintenance door 19. The sheet P having a printing process completed in the image forming assembly 12 is selectively discharged either to this external discharge tray 152 or to the internal discharge tray 151.

A summary of the internal construction of the image forming apparatus 10 is described below with reference to FIG. 2. As shown in FIG. 2, the image forming assembly 12 includes the photoconductive drum 121 substantially in its center. The photoconductive drum 121 has the circumferential surface thereof uniformly charged by a charger unit 122 disposed at a position immediately to the right thereof while being rotated clockwise about its central axis. An electrostatic latent image is formed on the circumferential surface of the photoconductive drum 121 by a laser beam from the exposure unit 123 based on the image information of a document image read by the image reader 16. Developer (hereinafter, "toner") is supplied from a developing unit 124 provided below the photoconductive drum 121 toward this electrostatic latent image, whereby a toner image is formed on the circumferential surface of the photoconductive drum 121.

A sheet P fed from either one the sheet cassettes 141 of the sheet storing section 14 is conveyed toward the photoconductive drum 121 bearing the toner image via a vertical sheet conveyance path 101 and a pair of registration rollers 142. The toner image borne on the circumferential surface of the photoconductive drum 121 is transferred to this sheet P by the action of the transfer roller 125 opposed to the photoconductive drum 121 at the left side of the photoconductive drum 121. The sheet P having the toner image transferred thereto is conveyed to the fixing device 13 by being separated from the photoconductive drum 121.

The photoconductive drum 121 having the toner image completely transferred therefrom continues to be rotated clockwise, whereby the circumferential surface thereof is cleaned by a cleaner 126 disposed right above the photoconductive drum 121. The cleaned circumferential surface of the photoconductive drum 121 heads for the charger unit 122 for the next image forming operation.

The fixing device 131 includes a fixing roller 131 internally provided with an electric heating element such as a halogen lamp and a pressure roller 132 opposed to the fixing roller 131 to the left of the fixing roller 131. The sheet P conveyed from the image forming assembly 12 is heated and pressed by passing through a nip portion between the fixing roller 131 and the pressure roller 132, whereby the toner image is fixed.

The sheet P after the fixing process is discharged to the internal discharge tray 151 of the discharging portion 15 via a discharging conveyance path 102 provided above the fixing device 13 or to the external discharge tray 152 in the case of simplex printing.

On the other hand, in the case of duplex printing, the front half of the sheet P after the fixing process is discharged to a temporary retraction space 153 above the internal discharge tray 151 via a back-and-forth conveyance path 103 provided above the discharging conveyance path 102. Thereafter, the sheet P is conveyed in a reverse direction via a backward conveyance path 104 and fed to the image forming assembly 12 again while being turned upside down, whereby printing is applied to the underside thereof. The sheet P having both sides printed is discharged to the discharge tray 151 or the external discharge tray 152.

In such an image forming apparatus 10, a cover member 20 openable and closable relative to the image forming assembly 12 is provided immediately inward of the maintenance door 19 on the left wall of the lower main body 111. This cover member 20 is arranged to be enclosed at the right side of the closed maintenance door 19. The cover member 20 has the bottom end thereof supported rotatably about a supporting shaft 21 supported in the lower main body 111 with the bottom end thereof located slightly above that of the maintenance door 19. Such a cover member 20 is displaceable between a closing position (shown by solid line in FIG. 2) to close the left surface of the image forming assembly 12 and an opening position (shown by chain double-dashed line in FIG. 2) to expose this left surface by rotating in forward and reverse directions about the supporting shaft 21.

With the cover member 20 set at the closing position, the vertical sheet conveyance path 101 for conveying a sheet P fed from the sheet cassette 141 or the manual feed tray 18 is defined to the right of the cover member 20. Such a cover member 20 is provided in order to expose a jammed sheet P by displacing the cover member 20 to the opening position and to enable the jammed sheet P to be easily removed upon an occurrence of a paper jam in the vertical sheet conveyance path 101 arranged to the left wall side of the image forming assembly 12.

The backward conveyance path 104 for conveying the sheet P having only one side printed in the reverse direction upon printing both sides of the sheet P is defined between the right surface of the maintenance door 19 set at the closing position and the left surface of the cover member 20 set at the closing position. The sheet P conveyed in the reverse direction along the backward conveyance path 104 is introduced to the vertical sheet conveyance path 101 below the photoconductive drum 121 while being turned upside down.

The sheet P manually fed from the manual feed tray 18 is dispensed to the left by the driving of a dispense roller 182 disposed at the back side (left side) of the manual feed tray 18. Thereafter, the sheet P is introduced to a position slightly below the photoconductive drum 121 in the vertical sheet conveyance path 101 via a pair of conveyance rollers 183, the conveyance unit 30 and the intermediate unit 40.

The intermediate unit 40 includes a receiving port facing the downstream end of the conveyance unit 30, a discharging port opposed to the right wall of the vertical sheet conveyance path 101 and an intermediate conveyance path 44 formed between these two ports. The sheet P conveyed from the conveyance unit 30 is fed to the vertical sheet conveyance path 101 via the intermediate conveyance path 44 in the intermediate unit 40.

Accordingly, the sheet P manually fed from the manual feed tray 18 is fed to the image forming assembly 12 via the dispense roller 182, the pair of conveyance rollers 183, the conveyance unit 30, the intermediate conveyance path 44 of the intermediate unit 40 and the vertical sheet conveyance path 101. Thereafter, a toner image is transferred to the sheet P by the photoconductive drum 121 and fixed thereto by the fixing device 131.

The conveyance unit 30 is made insertable into and detachable from the lower main body 111 in forward and backward directions (directions toward the front and back sides of the plane of FIG. 2) in order to enable a maintenance operation, a jam removal operation and the like to be easily performed. A locking mechanism 50 is provided to lock the conveyance unit 30 so that the conveyance unit 30 is not pulled out from the lower main body 111 unless the cover member 20 is opened.

Such a locking mechanism 50 is provided for the following reason. When a paper jam occurs in the conveyance unit 30, a jammed sheet P is present from the conveyance unit 30 to the vertical sheet conveyance path 101 via the intermediate unit 40 in many cases. In such cases, if the conveyance unit 30 is pulled out from the lower main body 111 without opening the cover member 20, only the downstream side (right side) of the jammed sheet P is pulled out together with the conveyance unit 30 while the upstream side (left side) thereof remains in the intermediate unit 40, with the result that the sheet P is torn apart. If this happens, it becomes difficult to remove the paper jam. In order to prevent the sheet P from being torn apart, the locking mechanism 50 is provided which prevents the conveyance unit 30 from being pulled out unless the cover member 20 is opened.

Figure 3:
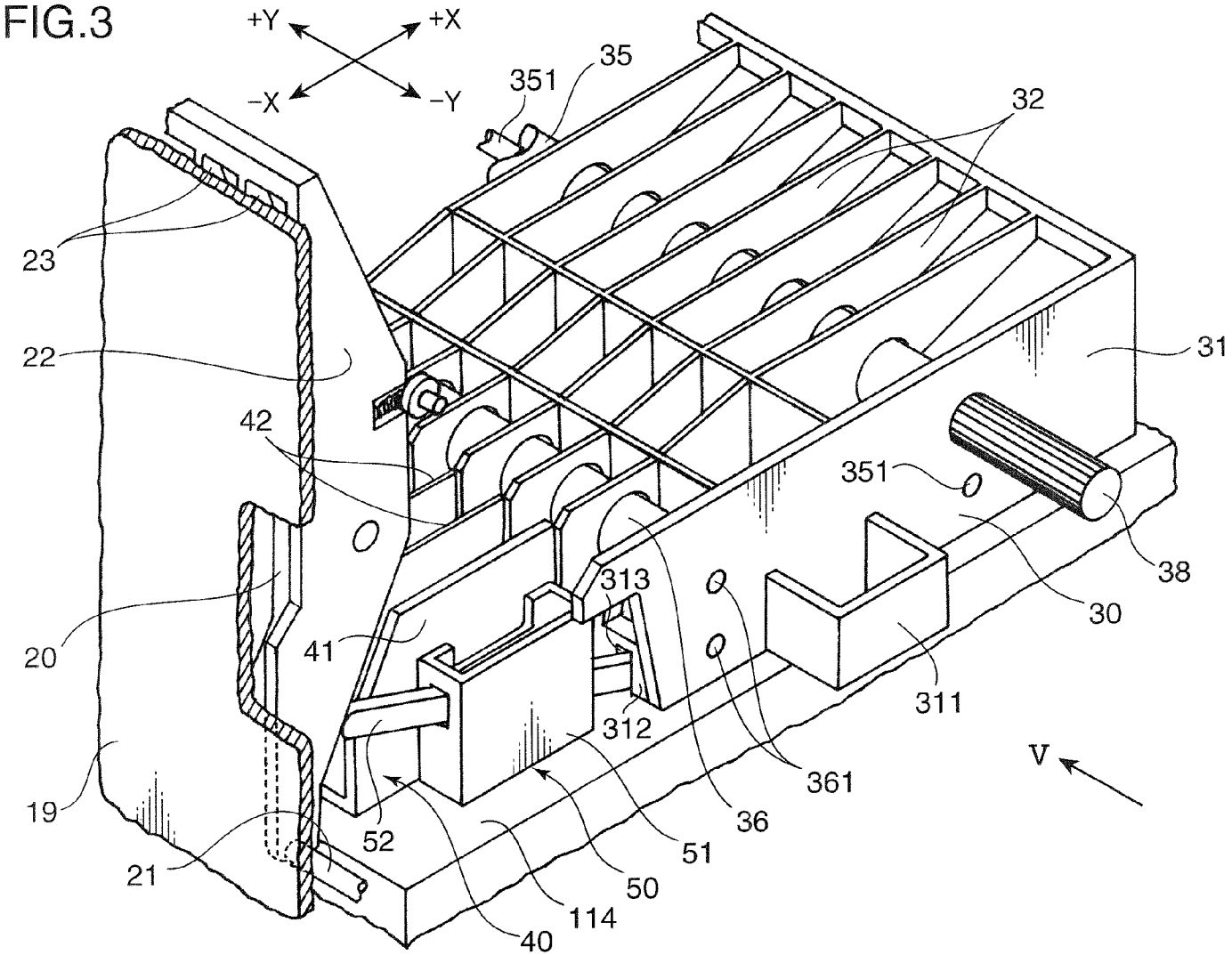
FIG. 3 is a partial perspective view showing the interior of an apparatus main body.
Figure 4:
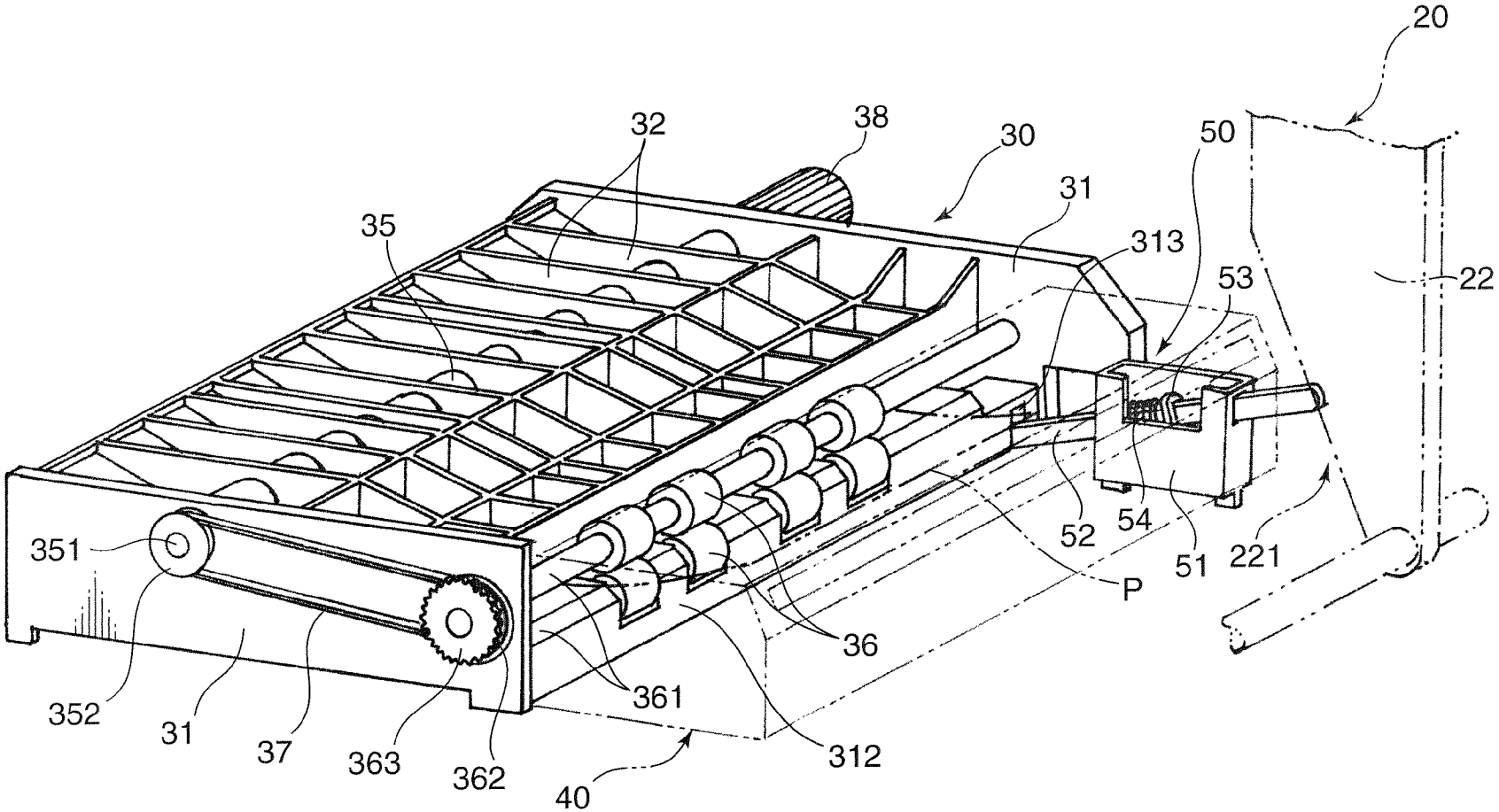
FIG. 4 is a perspective view showing one embodiment of a conveyance unit.
Figure 5:
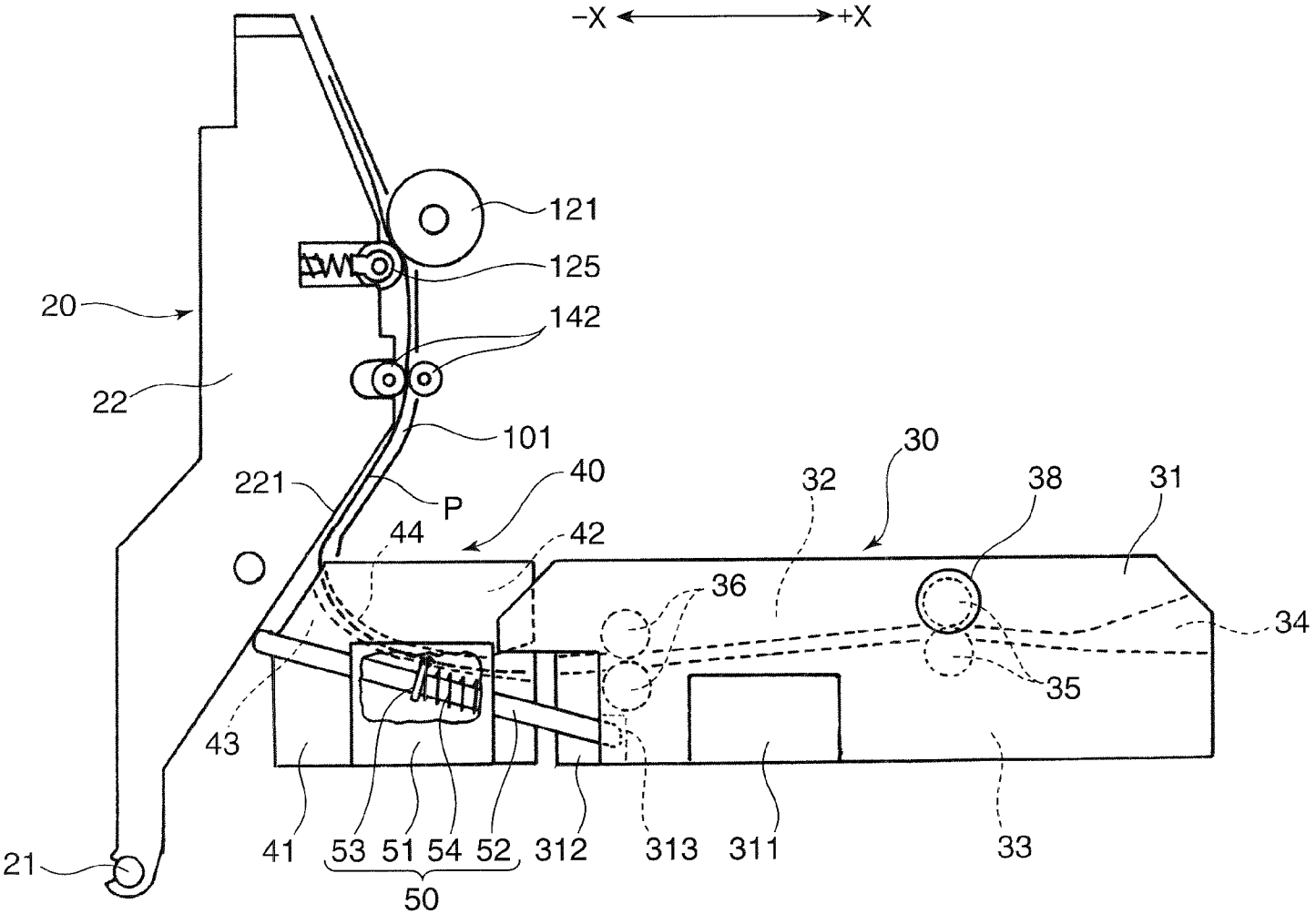
FIG. 5 is a section (front view) along an arrow V of FIG. 3, FIGS. 6A, 6B are an exploded perspective view partly cut away and an assembled perspective view showing a first embodiment of a locking mechanism.

The conveyance unit 30, the intermediate unit 40 and the locking mechanism 50 are described below with reference to FIGS. 3 to 5. FIG. 3 is a partial perspective view of the interior of the apparatus main body 11 showing a relative positional relationship of the cover member 20, the conveyance unit 30, the intermediate unit 40 and the locking mechanism 50, FIG. 4 is a perspective view showing one embodiment of the conveyance unit 30 and FIG. 5 is a section (front view) along an arrow V of FIG. 3. The indication of directions by X and Y in FIGS. 3 to 5 is the same as in the case of FIG. 1 (X: transverse directions (−X: leftward, +X: rightward) and Y: forward and backward directions (−Y: forward, +Y: backward)).

The cover member 20 includes a pair of front and rear side plates 22 spaced part in width direction (only the front side plate 22 is shown in FIGS. 2 and 4) and a plurality of conveying fins 23 arranged side by side in forward and backward directions between the pair of side plates 22 and having substantially the same shape as the side plates 22. These side plates 22 and conveying fins 23 have arched shapes whose middle parts project to the right when viewed from front. One side surface of the vertical sheet conveyance path 101 (see FIG. 2) for conveying the sheet P toward the photoconductive drum 121 is formed by the right edge surfaces of the plurality of respective conveying fins 23 (inner surface of the cover member 20).

The cover member 20 has the bottom end thereof set substantially at the same level as the vertical center of the intermediate unit 40. Thus, the sheet P fed from the intermediate unit 40 is introduced to the vertical sheet conveyance path 101 while being guided by the plurality of conveying fins 23 to have a conveying direction thereof changed from a transverse direction to a vertical direction.

The supporting shaft 21 supporting the cover member 20 penetrates the side plates 22 and the conveying fins 23 at the bottom end of the cover member 20, and the front and rear ends thereof is supported on unillustrated frames of the apparatus main body 11 at front and rear sides. Thus, the cover member 20 is displaceable between the closing position (shown by solid line in FIG. 2) and the opening position (shown by chain double-dashed line in FIG. 2) by being rotated in forward and reverse directions about the supporting shaft 21.

The intermediate unit 40 is a unit fixed to a partition plate 114 partitioning the sheet storing section 14 (see FIG. 2) and the image forming assembly 12 in the apparatus main body 11. The intermediate unit 40 has a substantially rectangular shape in front view and includes a pair of front and rear side plates 41 spaced apart in width direction (only the front side plate 41 is shown in FIG. 3) and a plurality of upper and lower conveying fins 42, 43 (see FIG. 5) arranged side by side in forward and backward directions between the pair of side plates 41 and having substantially the same shape as the side plates 41.

The intermediate conveyance path 44 whose downstream end is curved upward toward the vertical sheet conveyance path 101 is defined between the upper and lower conveying fins 42, 43. Accordingly, the sheet P horizontally fed from the conveyance unit 30 to the intermediate unit 40 passes in the intermediate conveyance path 44 and is vertically fed toward the vertical sheet conveyance path 101 from the downstream end of the intermediate conveyance path 44.

The conveyance unit 30 is so mounted on the partition wall 114 at a position immediately upstream of the intermediate unit 40 as to be detachably insertable into the apparatus main body 11. The conveyance unit 30 has a substantially laterally long rectangular shape in front view and includes a pair of front and rear side plates 31 spaced apart in width direction (only the front side plate 31 is shown in FIG. 3) and a plurality of upper and lower conveying fins 32, 33 (see FIG. 5) arranged side by side in forward and backward directions between the pair of side plates 31 and having substantially the same shape as the side plates 31.

A conveyance-unit conveyance path 34 extending substantially in horizontal direction in the conveyance unit 30 is defined between the upper and lower conveying fins 32, 33. Accordingly, the sheet P fed to the conveyance unit 30 from the manual feed tray 18 via the dispense roller 182 and the pair of conveyance rollers 183 (see FIG. 2) passes in the conveyance-unit conveyance path 34 and is fed toward the intermediate conveyance path 44 of the intermediate unit 40 from the downstream end of the conveyance-unit conveyance path 34.

Upstream roller shafts 351 and downstream roller shafts 361 are disposed between the pair of side plates 31. At a position slightly to the right of a transverse center, the upstream roller shafts 351 support pairs of upper and lower upstream conveyance rollers 35 arranged at the opposite sides of the conveyance-unit conveyance path 34. The downstream roller shafts 361 support pairs of upper and lower downstream conveyance rollers 36 arranged at left end positions. The circumferential surfaces of the respective pairs of upstream and downstream conveyance rollers 35, 36 are held in contact.

As shown in FIG. 4, an upstream pulley 352 is concentrically and integrally rotatably fitted on the rear end of the upper one of the pair of upstream roller shafts 351 penetrating the rear side plate 31. Further, a downstream pulley 362 is concentrically and integrally rotatably fitted on the rear end of the upper one of the pair of downstream roller shafts 352 penetrating the rear side plate 31. A link belt 37 is mounted between the upstream pulley 352 and the downstream pulley 362.

A driven gear 363 is further concentrically and integrally rotatably mounted on the upper downstream roller shaft 361. A driving force of an unillustrated drive motor provided at a suitable position in the apparatus main body 11 is transmitted to this driven gear 363, whereby the upper downstream roller shaft 361 rotates about its central axis. This rotation is transmitted to the upstream pulley 352 and the upper upstream roller shaft 351 via the link belt 37, whereby the upstream roller shafts 351 simultaneously rotate in the same direction as the downstream roller shafts 361.

By the synchronous rotation of the upstream and downstream conveyance roller pairs 35, 36 by the synchronous rotation of the upstream and downstream roller shafts 351, 361, the sheet P introduced to the conveyance-unit conveyance path 34 is conveyed toward the intermediate unit 40 in the conveyance-unit conveyance path 34 while being held between the pairs of conveyance rollers 35, 36.

In this embodiment, a concentric and integrally rotatable conveyance dial 38 is mounted on the front end of the upper upstream roller shaft 351. The conveyance dial 38 is rotated by a user, such as in the case of an occurrence of a paper jam in the conveyance-unit conveyance path 34. When the conveyance dial 38 is rotated, the upstream and downstream conveyance roller pairs 35, 36 rotate to discharge the jammed sheet P.

A grip 311 U-shaped in plan view is provided at a substantially middle position of the front side plate 31. The grip 311 is held by the user to pull the conveyance unit 30 out of the apparatus main body 11 at the time of a maintenance operation or upon an occurrence of a paper jam in the conveyance unit 30.

A supporting block 312 for supporting the lower downstream roller shaft 361 extends at a left lower position between the pair of side plates 31. A lock groove 313, into which the left end of a locking rod 52 to be described later is fitted, is formed in the left surface of the front end of the supporting block 312.

The locking mechanism 50 is for locking a movement of the conveyance unit 30 to make it impossible to pull the conveyance unit 30 from the apparatus main body 11 with the cover member 20 set at the closing position. Such a locking mechanism 50 is provided on the partition plate 114 at a position before the intermediate unit 40 between the cover member 20 and the conveyance unit 30.

Figure 6A:
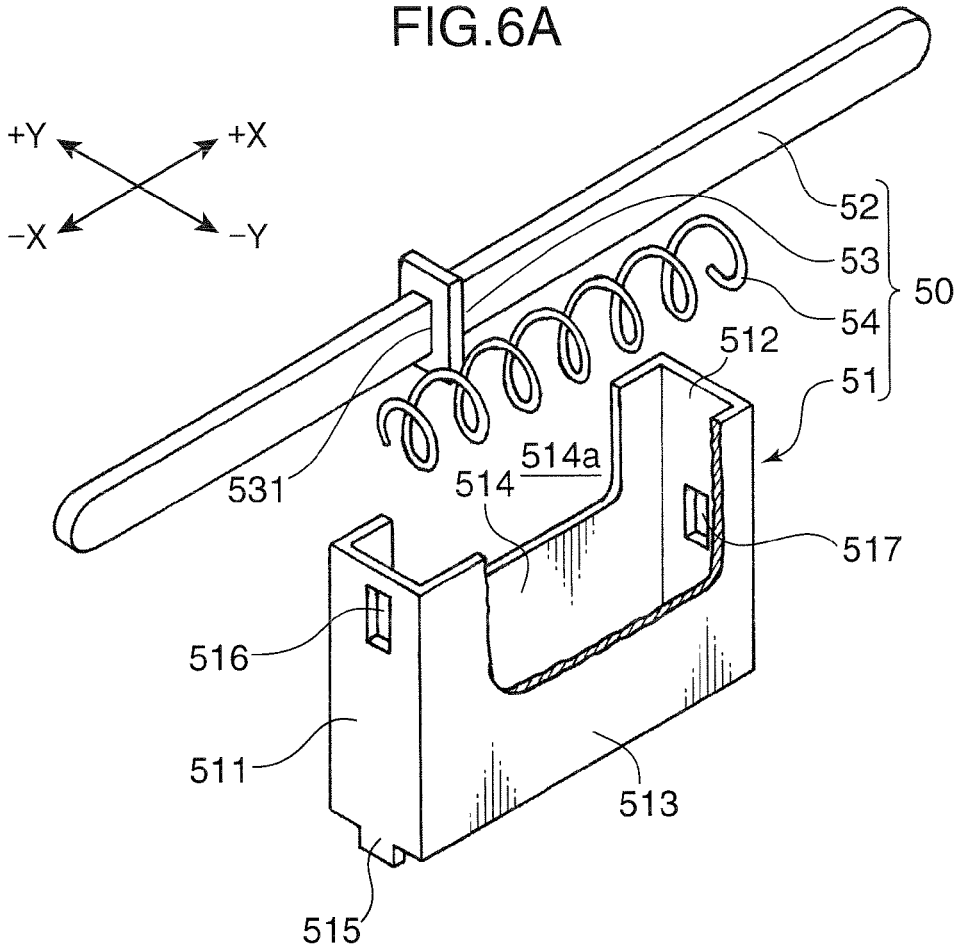
Figure 6B:
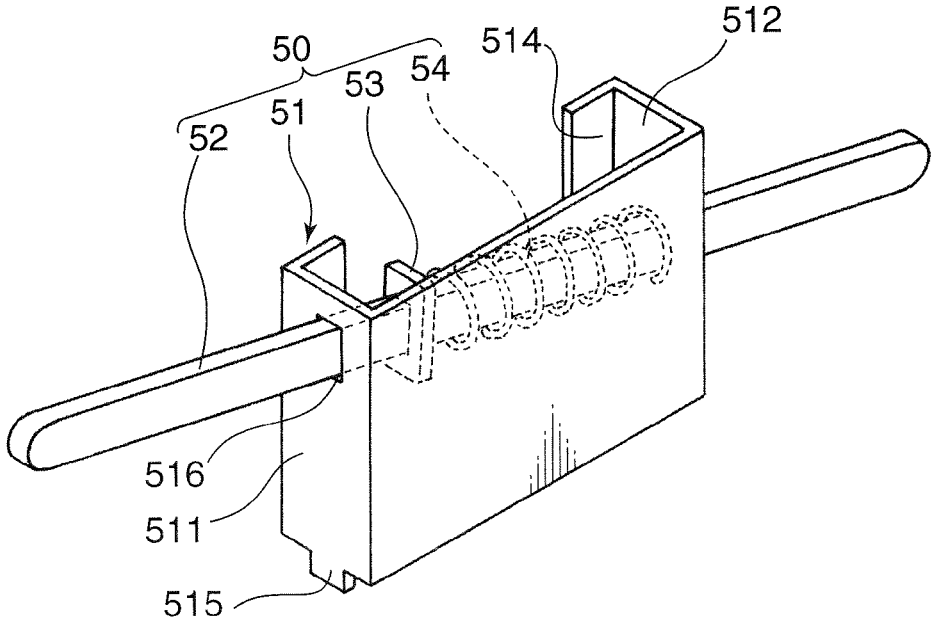

The locking mechanism 50 according to a first embodiment is described below with reference to FIGS. 6A and 6B and, if necessary, also with reference to FIGS. 1 to 5. FIGS. 6A and 6B are perspective views showing the first embodiment of the locking mechanism 50, wherein FIG. 6A is an exploded perspective view partly cut away and FIG. 6B is an assembled perspective view. The indication of directions by X and Y in FIGS. 6A and 6B is the same as in the case of FIG. 1 (X: transverse directions (−X: leftward, +X: rightward) and Y: forward and backward directions (−Y: forward, +Y: backward)).

As shown in FIG. 6A, the locking mechanism 50 includes a rectangular parallelepipedic frame 51 having a rectangular plan view, the locking rod 52 mounted to penetrate this frame 51, a flange 53 fixedly on this locking rod 52 and a coil spring 54 fitted on the locking rod 52 in a compressed state in the frame 51. The flange 53 is formed with a rectangular hole 531 through which the locking rod 52 penetrates in sliding contact.

The frame 51 includes a left plate 511 having a vertically long rectangular shape, a right plate 512 opposed to the left plate 511 at the right side and having the same shape as the left plate 511, a front plate 513 extending between the front edges of the left and right plates 511 and 512 and longer in transverse direction, and a rear plate 514 extending between the rear edges of the left and right plates 511, 512 and having the same shape as the front plate 513. A locking projection 515 projects downward from the bottom edge of each of the left and right plates 511, 512. The locking mechanism 50 is fixed to the partition plate 114 of the apparatus main body 11 by press-fitting these locking projections 515 into unillustrated locking holes perforated in the partition plate 114.

An upper insertion hole 516 for allowing the passage of the locking rod 52 is formed at an upper position of the left plate 511, and a lower insertion hole 517 for allowing the passage of the locking rod 52 is formed at a lower position of the right plate 512. The locking rod 52 is inserted through these upper and lower insertion holes 516, 517.

The positions of the upper and lower insertion holes 516, 517 are set such that a leftward extension of a straight line connecting the center positions of the upper and lower insertion holes 516, 517 intersects with the right edge of the side plate 22, and a rightward extension thereof heads for the lock groove 313 (see FIG. 4).

The length of the locking rod 52 is set such that, with the locking rod 52 inserted through the upper and lower insertion holes 516, 517, the upper end of the locking rod 52 rests on a right-down inclined edge 221 of the front side plate 22 of the cover member 20 set at the closing position and the bottom end thereof is fitted in the lock groove 313 formed in the supporting block 312 of the conveyance unit 30 as shown in FIG. 5.

The flange 53 is fitted on the locking rod 52 and fixed, for example, by welding. The flange 53 is so positioned as to be located immediately to the right of the upper insertion hole 516 with the locking rod 52 inserted through the upper and lower insertion holes 516, 517 and the cover member 20 set at the opening position.

The coil spring 54 is set to have a length slightly longer than a distance between the center positions of the upper and lower insertion holes 516, 517. Accordingly, the coil spring 54 is compressed and elastically deformed by being mounted in the frame 51 while being fitted on the locking rod 52. The coil spring 54 is mounted in a compressed state between the flange 53 and the right plate 512 with the flange 53 held in contact with the right surface of the left plate 511. By inserting the locking rod 52 through the upper insertion hole 516 of the left plate 511, the rectangular hole 531 of the flange 53 and the lower insertion hole 517 of the right plate 512 in this way, the locking rod 52 and the coil spring 54 are mounted in the frame 51 as shown in FIG. 6B.

In this embodiment, the rear plate 514 is cut downward from the upper edge thereof to form a cutout 514*a*. The flange 53 is welded through this cutout 514*a* to be fixed to the locking rod 52.

Figure 7A:
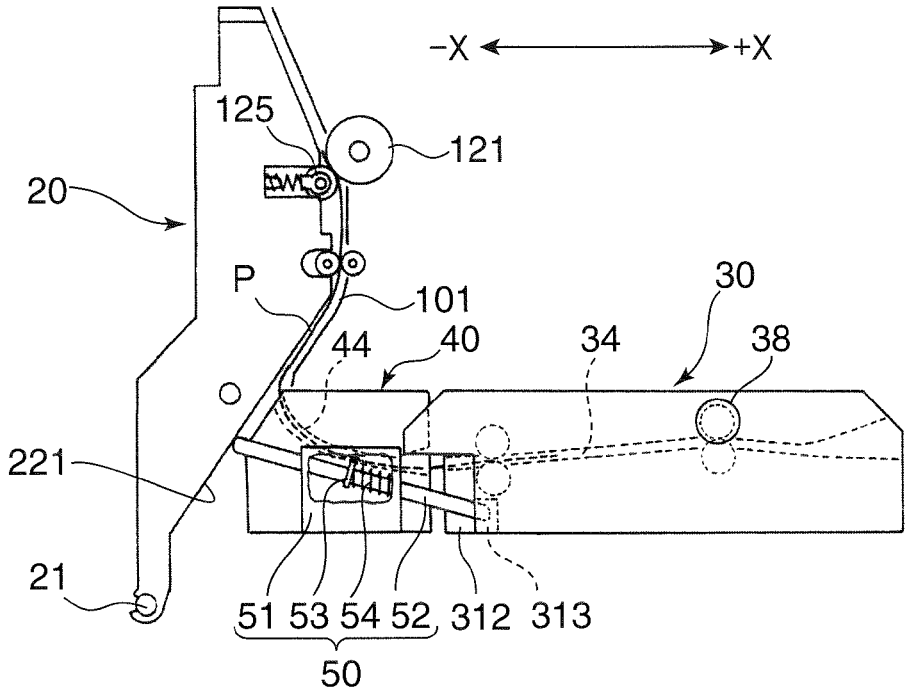
Figure 7B:
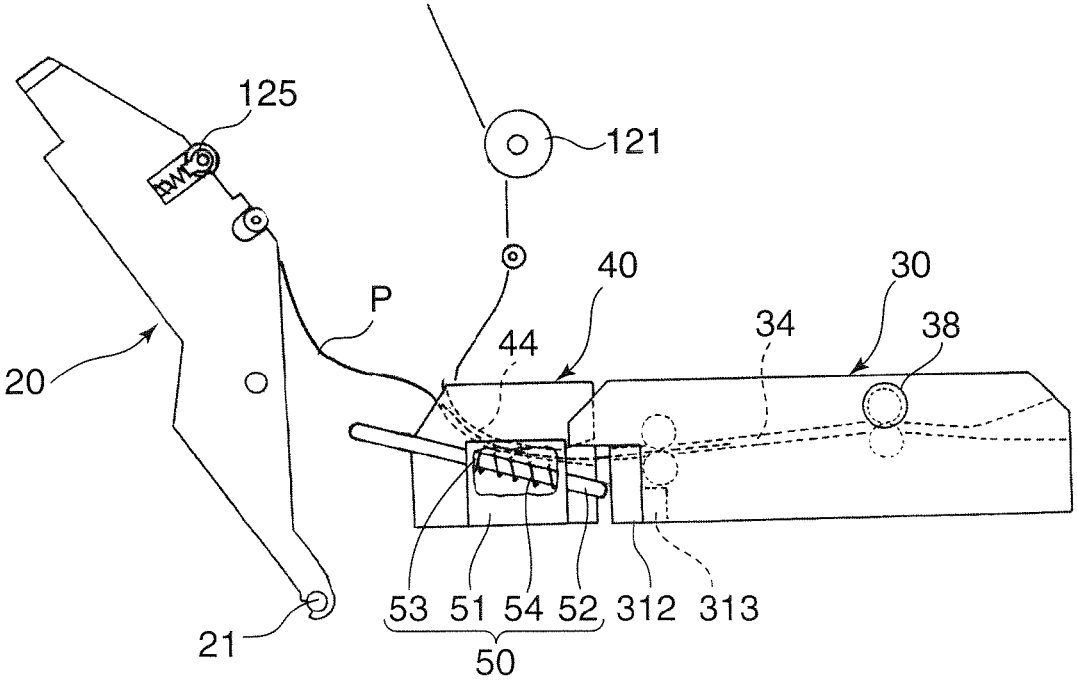

FIGS. 7A and 7B are diagrams showing the function of the locking mechanism 50, wherein FIG. 7A shows a state where the cover member 20 is set at the closing position and FIG. 7B shows a state where the cover member 20 is set at the opening position. The indication of directions by X in FIGS. 7A and 7B is the same as in the case of FIG. 1 (X: transverse directions (−X: leftward, +X: rightward)).

As shown in FIG. 7A, the right-down inclined edge 221 (contact surface) of the side plate 22 of the cover member 20 presses the locking rod 52 to the right against a biasing force of the coil spring (biasing member) with the cover member 20 set at the closing position. Thus, a projecting amount of the locking rod 52 toward a right down side from the frame 51 increases and the right end of the locking rod 52 is locked by being fitted in the lock groove 313 (groove portion) of the supporting shaft 312 of the conveyance unit 30. Accordingly, the conveyance unit 30 cannot be pulled out from the apparatus main body 11.

While being set at the closing position, the cover member 20 is locked at the closing position by an unillustrated locking member provided at a suitable position thereof. On the other hand, this locked state is canceled to free the cover member 20 by the user performing a specified operation to the locking member.

Accordingly, even if the user tries to pull the conveyance unit 30 from the apparatus main body 11 by mistake prior to the opening of the cover member 20 in such a case where a paper jam occurs with a jammed sheet present from the conveyance unit 30 to the intermediate unit 40 when the cover member 20 is set at the closing position, the conveyance unit 30 cannot be pulled out. Thus, an occurrence of an inconvenience of tearing the jammed sheet P apart can be prevented.

On the contrary, if the cover member 20 is opened beforehand as shown in FIG. 7B, the cover member 20 no longer presses the left end of the locking rod 52, wherefore the locking rod 52 receives the biasing force of the coil spring 54 via the flange 53 to move to the left. Since the right end of the locking rod 52 comes out of the lock groove 313 of the conveyance unit 30 by this movement, the conveyance unit 30 can be pulled out forward (toward the front side of the plane of FIG. 7B). This causes the opening operation of the cover member 20 to be performed prior to the jam processing.

By forcing the opening operation of the cover member 20 to be prioritized, the user can be guided to pull the jammed sheet P first from the cover member 20. By the user pulling the upstream end of the jammed sheet P, the downstream end of the sheet P can be moved from the conveyance unit 30 to the intermediate unit 40. Even if the conveyance unit 30 is pulled out in this state, there is no likelihood of tearing the sheet P apart since the sheet P has been already moved to the intermediate unit 40 or removed. Therefore, the paper jam removal processing can be made more efficient.

Figure 8A:
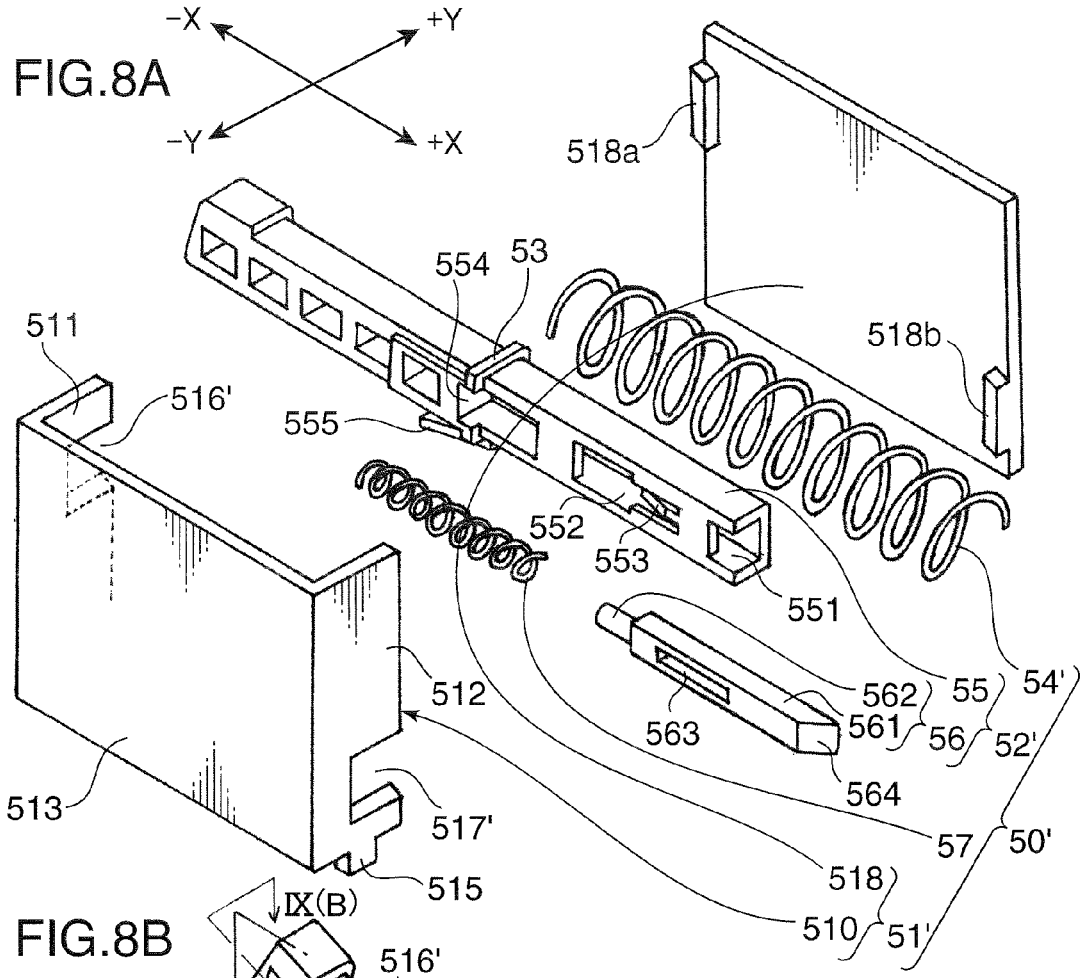
FIGS. 8A, 8B are an exploded perspective view and an assembled perspective view showing a second embodiment of the locking mechanism.
Figure 8B:
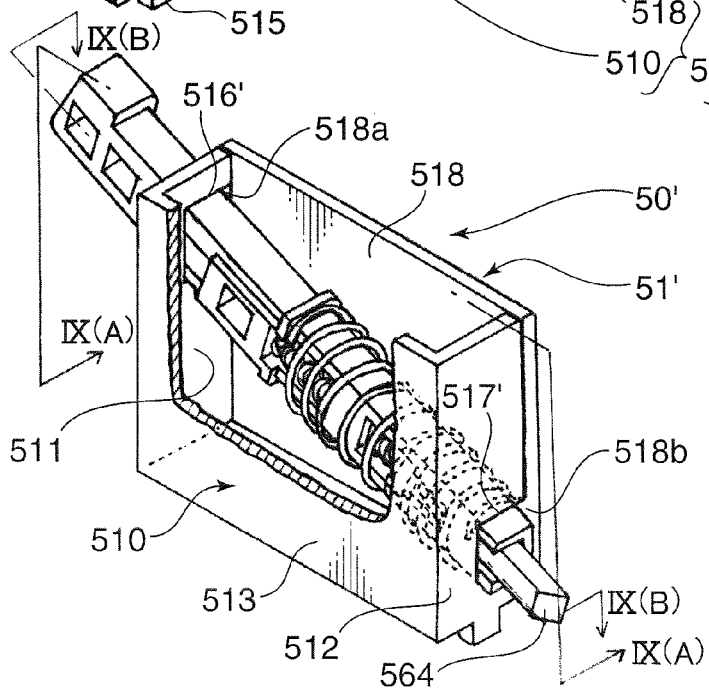
Figure 9A:
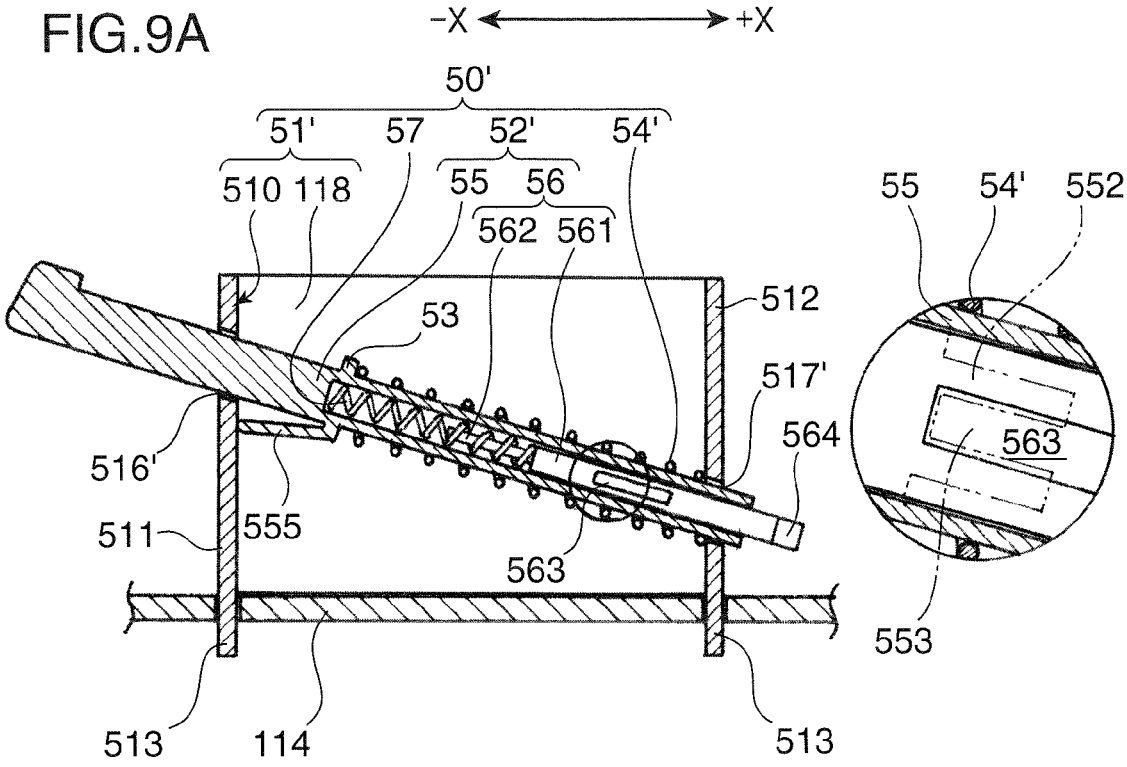
FIG. 9A is a section along IX(A)-IX(A) of FIG. 8B
Figure 9B:
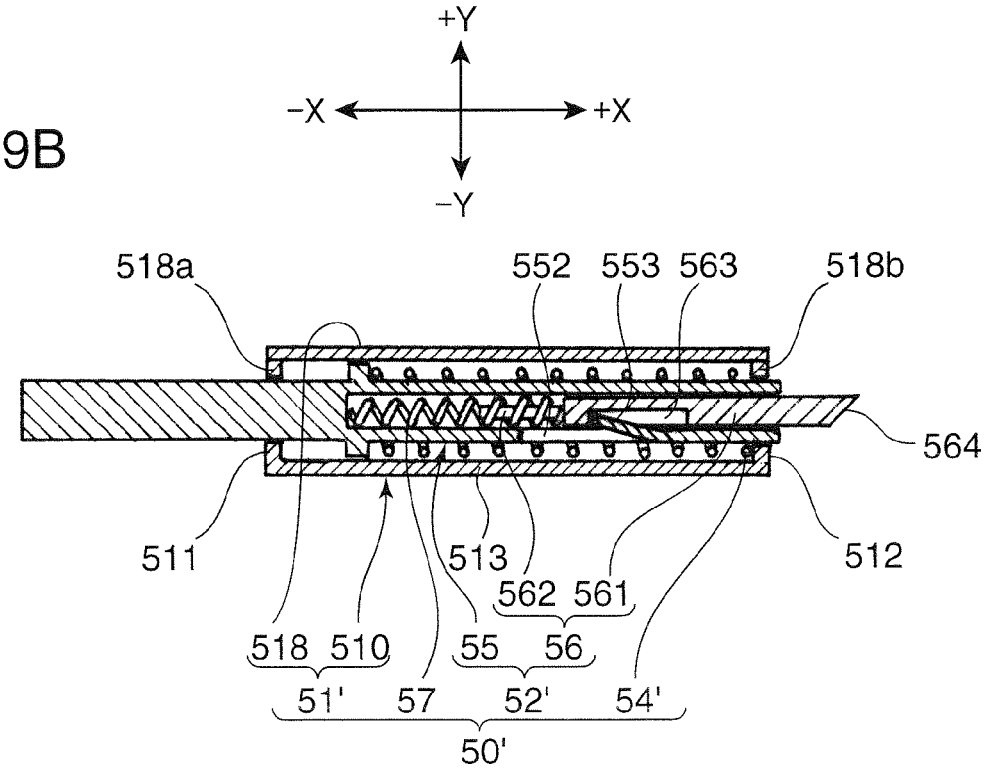
FIG. 9B is a section along IX(B)-IX(B) of FIG. 9B.

Next, a locking mechanism 50' according to a second embodiment is described. FIGS. 8A and 8B are perspective views showing the locking mechanism 50' according to the second embodiment, wherein FIG. 8A is an exploded perspective view and FIG. 8B is an assembled perspective view. FIG. 9A is a section along IX(A)-IX(A) of FIG. 8B and FIG. 9B is a section along IX(B)-IX(B) of FIG. 8B. A large circle in FIG. 9A is an enlarged view of a small circle drawn in a locking rod 52'. The indication of directions by X and Y in FIGS. 8A to 9B is the same as in the case of FIG. 6 (X: transverse directions (−X: leftward, +X: rightward) and Y: forward and backward directions (−Y: forward, +Y: backward)).

As shown in FIG. 8A, the locking mechanism 50' of the second embodiment includes a frame 51' having a rectangular parallelepipedic shape in its assembled state, the locking rod 52' mounted to penetrate this frame 51', a large-diameter coil spring 54' fitted on this locking rod 52' in a compressed state and a small-diameter coil spring 57 fitted in the locking rod 52' in a compressed state.

The frame 51' includes a frame main body 510 having a U-shaped plan view, and a lid 518 for closing a rear opening of this frame main body 510. The frame main body 510 includes a left plate 511 having a vertically long rectangular shape, a right plate 512 opposed to the left plate 511 at the right side and having the same shape as the left plate 511 and a front plate 513 extending between the front edges of the left and right plates 511 and 512 and longer in transverse direction.

A locking projection 515 projects downward from the bottom edge of each of the left and right plates 511, 512. The locking mechanism 50' is fixed to the partition plate 114 (see FIG. 3) of the apparatus main body 11 by press-fitting these locking projections 515 into the unillustrated locking holes perforated in the partition plate 114.

An upper cutout groove 516' for allowing the passage of the locking rod 52' is formed at an upper position of the left plate 511, and a lower cutout groove 517' for allowing the passage of the locking rod 52' is formed at a lower position of the right plate 512. The locking rod 52' is inserted through these upper and lower cutout grooves 516', 517'.

The positions of the upper and lower cutout grooves 516', 517' are set such that an leftward extension of a straight line connecting the center positions of the upper and lower cutout grooves 516', 517' intersects with the right edge of the side plate 22, and a rightward extension thereof heads for the lock groove 313 (see FIG. 4).

The lid 518 is set to have a rectangular shape dimensioned identically to the frame plate 513. The lid 518 is fixed to the rear edges of the left and right plates 511, 512 of the frame main body 510 by adhesive or screws. An upper groove closing projection 518*a* is provided at a position of the left edge of the lid 518 corresponding to the upper cutout groove 516', and a lower groove closing projection 518*b* is provided at a position of the right edge of the lid 518 corresponding to the lower cutout groove 517'.

With the lid 518 mounted on the frame main body 510, the upper groove closing projection 518*a* is fitted in the upper cutout groove 516' and the lower groove closing projection 518*b* is fitted in the lower cutout groove 517'. In this way, there are formed a pair of holes for allowing the passage of the locking rod 52' corresponding to the upper and lower insertion holes 516, 517 of the first embodiment.

The locking rod 52' includes a locking rod main body 55 at a side toward the cover member 20 (left side), and a reciprocating rod 56 mounted at a side toward the conveyance unit 30 (right side) in this locking rod main body 55 in such a manner as to reciprocate. The reciprocating rod 56 is biased to the right by the small-diameter coil spring 57 while being mounted in the locking rod main body 55.

The locking rod main body 55 is in the form of a rectangular tube and has a flange 53 formed substantially in the longitudinal center thereof. This flange 53 functions as in the first embodiment to interfere with the left end of the large-diameter coil spring 54' fitted on the locking rod main body 55 at the right side of the flange 53.

The locking rod main body 55 is formed with a rectangular mounting hole 551 extending from the right end surface to the formation position of the flange 53, and the reciprocating rod 56 is mounted into this hole 551. A cutout window 552 communicating with the rectangular mounting hole 551 is formed at a position of the locking rod main body 55 slightly to the right of a center in forward and backward directions. A locking projecting piece 553 projecting to the left from the right edge is formed in this cutout window 552.

The locking projecting piece 553 is for retaining the reciprocating rod 56 fitted into the rectangular mounting hole 551. This locking projecting piece 553 is bent such that the left end thereof enter the rectangular mounting hole 551 (see FIG. 9B). When the reciprocating rod 56 is pushed into the rectangular mounting hole 551, the locking projecting piece 553 interferes with the front surface of the reciprocating rod 56, is restored to its original shape after being temporarily elastically deformed to escape from the inside of the rectangular mounting hole 551 and is fitted into the rectangular locking hole 563 of the reciprocating rod 56. In this way, the reciprocating rod 56 is retained. Further, a back wall 554 is provided at a position substantially corresponding to the flange 53 in the rectangular mounting hole 551.

A stopper projection 555 is so provided on the lower surface of the locking rod main body 55 as to project to the left from the flange 53. The left end of the stopper projection 555 is in contact with the inner side of the left plate 511 of the frame 51' with the locking rod 52' mounted in the frame 51'. This prevents the locking rod 52' from moving any further to the left.

The reciprocating rod 56 is set slightly shorter than a distance between the right end surface of the locking rod main body 55 and the back wall 554. The reciprocating rod 56 includes a rectangular column 561 fittable in sliding contact with the rectangular mounting hole 551 and having a substantially square section, and a cylindrical element 562 concentrically projecting to the left from the left end surface of the rectangular column 561 and having a diameter slightly smaller than one side of the rectangular column 561. The diameter of the cylindrical element 562 is slightly smaller than the inner diameter of the small-diameter coil spring 57.

An oblong locking hole 563 extending in transverse direction at a position corresponding to the locking projecting piece 553 is formed in the front surface of the rectangular column 561. A guiding inclined surface 564 inclined backward toward the right (i.e. so inclined as to be pushed by the conveyance unit 30 when the pulled-out conveyance unit 30 is mounted) is formed at the leading end (right end) of the front surface of the rectangular column 561.

Upon assembling the reciprocating rod 56, the cylindrical element 562 is fitted into the rectangular mounting hole 551 through a right opening with the small-size coil spring 57 in the lead in a state where the small-diameter coil spring 57 is first fitted on the cylindrical element 562. By this fitting operation, the small-diameter coil spring 57 comes to rest on the back wall 554 of the rectangular mounting hole 551. If the reciprocating rod 56 continues to be pushed, it is pushed into the rectangular mounting hole 551 while the small-diameter coil spring 57 is compressed and elastically deformed.

By this pushing operation, the locking projecting piece 553 enters the oblong locking hole 563 after being elastically deformed forward by coming into sliding contact with the front surface of the rectangular column 561 and, then, is restored to its original shape. Accordingly, by fitting the reciprocating rod 56 into the rectangular mounting hole 551, the left edge of the locking projecting piece 553 is retained in contact with the left surface of the oblong locking hole 563 as shown in the partial enlarged view in the circle of FIG. 9A and FIG. 9B and the reciprocating rod 56 is mounted in the locking rod main body 55 while being biased to the right by the small-diameter coil spring 57.

The locking rod 52' assembled in this way has the large-diameter coil spring 54' fitted on the right side thereof in a compressed state, and is inserted through the upper and lower cutout grooves 516', 517' formed in the left and right plates 511, 512 of the frame main body 510. In this state, the upper and lower groove closing projections 518*a*, 518*b* of the lid 518 are fitted into the upper and lower cutout grooves 516', 517'. Thereafter, the lid 518 is fixed to the frame main body 510 by adhesive or screws, whereby the locking mechanism 50' is completed as shown in FIGS. 8B and 9A.

Figure 10:
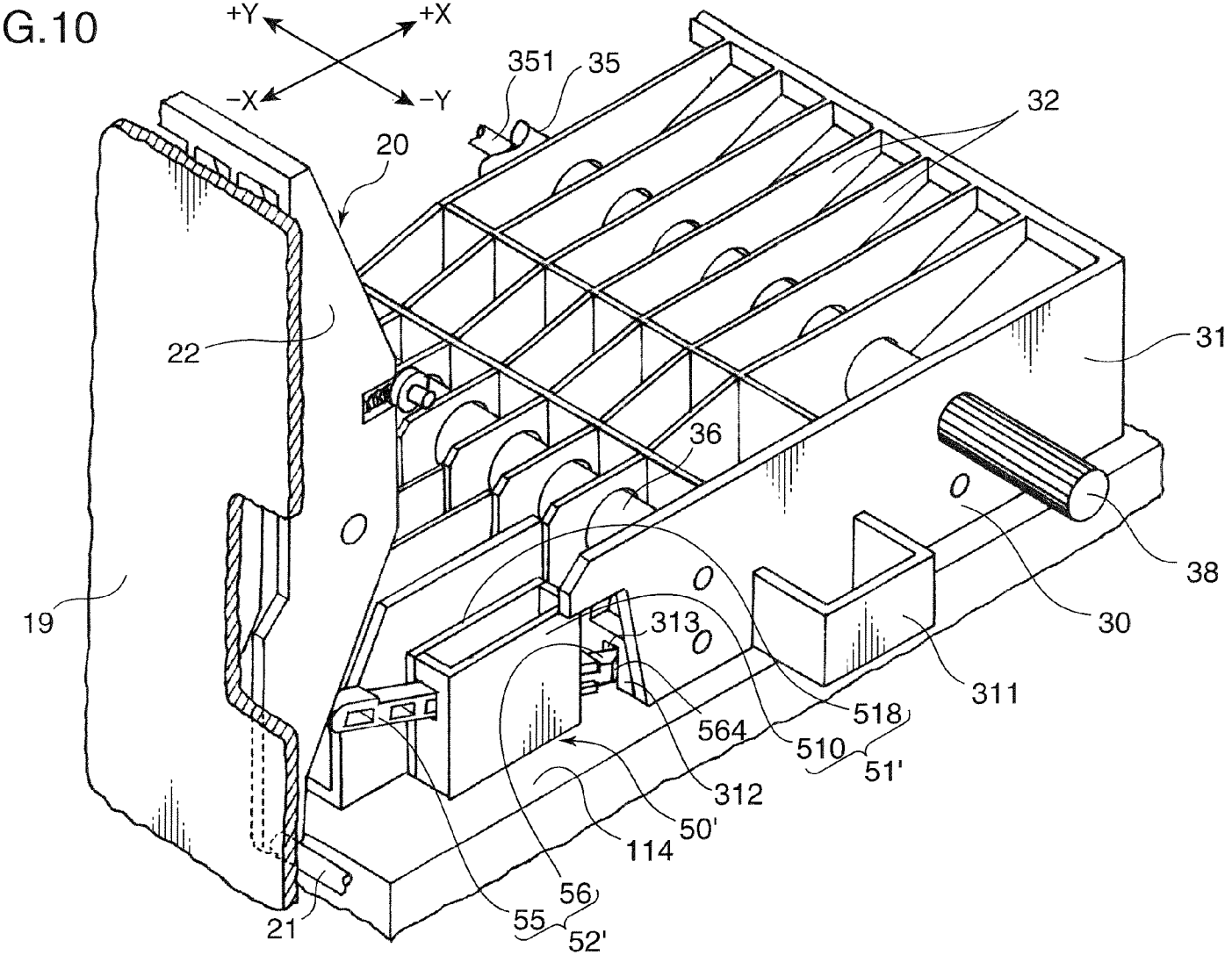
FIG. 10 is a perspective view showing a state where the locking mechanism according to the second embodiment is mounted on a partition plate of the apparatus main body.

FIG. 10 is a perspective view showing a state where the thus completed locking mechanism 50' according to the second embodiment is mounted on the partition plate 114 of the apparatus main body 11. The indication of directions by X and Y in FIG. 10 is the same as in the case of FIG. 3 (X: transverse directions (−X: leftward, +X: rightward) and Y: forward and backward directions (−Y: forward, +Y: backward)).

As shown in FIG. 10, the mounted state of the locking mechanism 50' on the partition plate 114 of the apparatus main body 11 is the same as in the case of the locking mechanism 50 of the previous first embodiment. Specifically, with the cover member 20 closed, the left end of the locking rod main body 55 of the locking rod 52' rests on the right edge of the side plate 22 of the cover member 20. Further, the right end of the reciprocating rod 56 of the locking rod 52' is fitted in the lock groove 313 formed in the supporting block 312 of the conveyance unit 30, whereby a forward movement of the conveyance unit 30 is prevented.

On the other hand, with the cover member 20 opened, the left end of the locking rod main body 55 is not pressed by the cover member 20, whereby the locking rod 52' moves to the left due to a biasing force of the large-diameter coil spring 54' (see FIGS. 8A, 8B). By this movement, the right end of the reciprocating rod 56 comes out of the lock groove 313 to be unlocked. Accordingly, the conveyance unit 30 can be pulled out from the apparatus main body 11. In other words, the locking and unlocking operations of the conveyance unit 30 by the locking mechanism 50' according to the second embodiment to prevent and enable the pull-out operation from the apparatus main body 11 are exactly the same as those by the locking mechanism 50 of the first embodiment previously described with reference to FIGS. 7A, 7B.

However, in the locking mechanism 50 according to the first embodiment, the rear end of the conveyance unit 30 might possibly interfere with the right end of the locking rod 52 in such a case where the cover member 20 is closed before the conveyance unit 30 once pulled out from the apparatus main body 11 is pushed into the apparatus main body 11. This could possibly lead to a problem that the conveyance unit 30 cannot be accommodated into the apparatus main body 11.

Figure 11A:
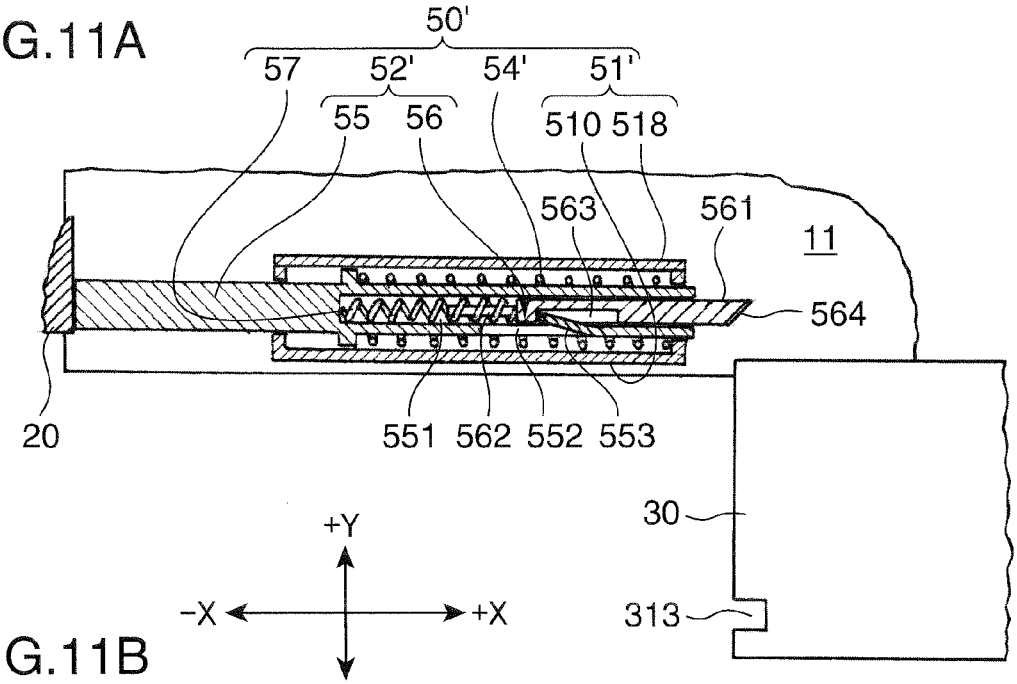
FIGS. 11A to 11C are plan views in section showing the function of the locking mechanism according to the second embodiment.
Figure 11B:
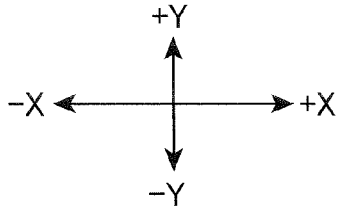
Figure 11B:
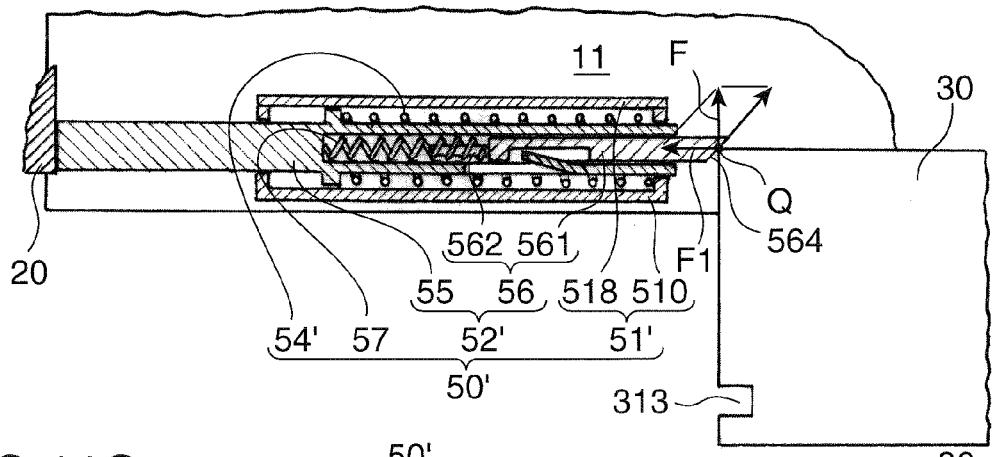
Figure 11C:
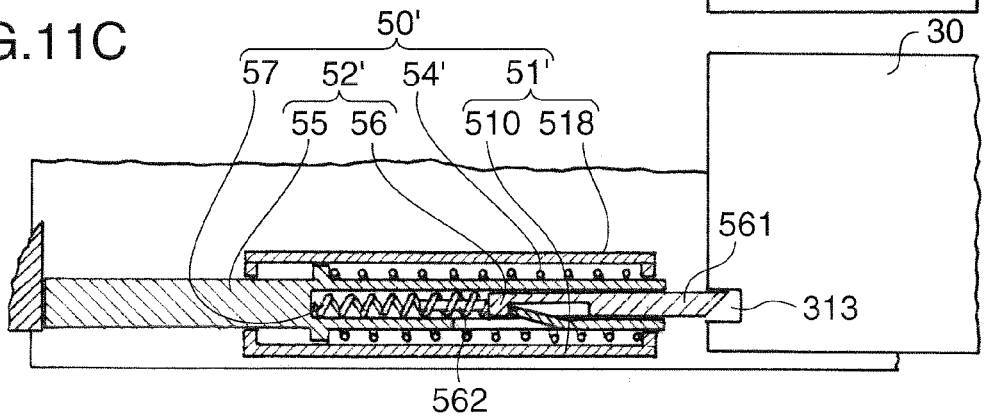

The locking mechanism 50' according to the second embodiment solves such a problem. The function of this locking mechanism 50' is described below. FIGS. 11A to 11C are plan views in section showing the function of the locking mechanism 50', wherein FIG. 11A shows a state where the conveyance unit 30 is completely pulled out from the apparatus main body 11, FIG. 11B shows a state where the conveyance unit 30 is started to be pushed into the apparatus main body 11 and FIG. 11C shows a state where the conveyance unit 30 is pushed in the apparatus main body 11. In FIGS. 11A to 11C, the size of the conveyance unit 30 relative to the locking mechanism 50' is shown considerably smaller than the actual relative size. The indication of directions by X and Y in FIGS. 11A to 11C is the same as in the case of FIG. 1 (X: transverse directions (−X: leftward, +X: rightward) and Y: forward and backward directions (−Y: forward, +Y: backward)).

First, when the cover member 20 is closed with the conveyance unit 30 pulled out from the apparatus main body 11 as shown in FIG. 11A, the cover member 20 pushes the left end of the locking rod main body 55. This causes the locking rod 52' to move to the right against the biasing force of the large-diameter coil spring 54'. At this time, a projecting amount of the reciprocating rod 56 from the frame 51' to the right is maximized.

If the conveyance unit 30 is pushed into the apparatus main body 11 in this state, the rear corner of the left end of the conveyance unit 30 interferes with the guiding inclined surface 564 of the rectangular column 561 of the reciprocating rod 56. If the conveyance unit 30 continues to be pushed with a pushing force F, a component of force F1 acts on the reciprocating rod 56 in a leftward direction at a contact point Q of the left rear corner of the conveyance unit 30 with the guiding inclined surface 564, wherefore the reciprocating rod 56 moves to the left against the biasing force of the small-diameter coil spring 57. By this leftward movement of the reciprocating rod 56, the left rear corner of the conveyance unit 30 passes the guiding inclined surface 564 at the right end of the reciprocating rod 56. Thereafter, the conveyance unit 30 is pushed into the apparatus main body 11 while the left surface thereof is held in sliding contact with the right end of the reciprocating rod 56.

With the conveyance unit 30 completely pushed in the apparatus main body 11, the lock groove 313 of the conveyance unit 30 faces the right end of the reciprocating rod 56. Thus, this reciprocating rod 56 moves to the right by the biasing force of the small-diameter coil spring 57 to be fitted into the lock groove 313. In this way, the conveyance unit 30 is locked and cannot be pulled out unless the cover member 20 is opened.

As described above, with the locking mechanism 50' of the second embodiment, the conveyance unit 30 can be pushed into the apparatus main body 11 even if the conveyance unit 30 is pulled out from the apparatus main body 11 after the cover member 20 is opened and the cover member 20 is closed prior to the pushing operation of the conveyance unit 30 into the apparatus main body 11 after a specified maintenance operation is performed. Therefore, the operability of the maintenance operation performed by pulling the conveyance unit 30 out from the apparatus main body 11 after the cover member 20 is opened can be improved.

As described above in detail, the image forming apparatuses 10 according to the above first and second embodiments are constructed such that a toner image formed by an image forming process based on image information in the image forming assembly 12 provided in the apparatus main body 11 is transferred to a sheet P. Each image forming apparatus 10 includes the conveyance unit 30 detachably insertable into the apparatus main body 11 for conveying a sheet P fed from the manual feed tray 18 to the image forming assembly 12, and the openable and closable cover member 20 provided on the wall facing the downstream end of the conveyance unit 30. The locking mechanism 50, 50' for preventing the conveyance unit 30 from being pulled out from the apparatus main body 11 unless the cover member 20 is opened is provided between the cover member 20 and the conveyance unit 30.

According to such a construction, with the cover member 20 closed, the conveyance unit 30 is prevented from being pulled out from the apparatus main body 11 by the locking mechanism 50, 50'. Thus, there is no likelihood that the conveyance unit 30 is pulled out from the apparatus main body 11 with a sheet P present between the vertical sheet conveyance path 101 (or the intermediate unit 40) inside the cover member 20 and the conveyance unit 30 and that the jammed sheet P is torn apart. Accordingly, there is no likelihood of complicating a jam processing. Further, the user can be let to notice that the cover member 20 has to be opened upon an occurrence of a paper jam since the conveyance unit 30 cannot be pulled.

For the above reason, the cover member 20 is first opened upon performing a jam processing. By doing so, the jammed sheet P can be removed from a position of connection of the conveyance unit 30 and the intermediate unit 40 by being pulled out from the vertical sheet conveyance path 101. Further, since the locked state of the conveyance unit 30 by the locking mechanism 50, 50' is canceled by opening the cover member 20, the conveyance unit 30 can be pulled out after the sheet P is removed from the jammed position and a confirmation operation and/or a maintenance operation can be performed to the conveyance unit 30.

The locking mechanism 50, 50' includes the locking rod 52, 52' that moves toward and away from the conveyance unit 30 as the cover member 20 is opened and closed. The length of the locking rod 52, 52' is set such that the locking rod 52, 52' interferes with the conveyance unit 30 with the cover member 20 closed while being not interfering with the conveyance unit 30 with the cover member 20 opened.

According to such a construction, the locking rod 52, 52' interferes with the conveyance unit 30 with the cover member 20 closed, whereby the conveyance unit 30 cannot be pulled out from the apparatus main body 11. Thus, there is no likelihood that the conveyance unit 30 is inadvertently pulled out from the apparatus main body 11 despite the fact that the cover member 20 is closed. On the other hand, with the cover member 20 opened, the conveyance unit 30 can be pulled out from the apparatus main body 11 since the locking rod 52, 52' does not interfere with the conveyance unit 30.

The apparatus main body 11 is provided with the openable and closable maintenance door 19 facing the cover member 20, and the backward conveyance path 104 for conveying the sheet P in the reverse direction at the time of duplex printing is defined between the maintenance door 19 and the cover member 20.

According to such a construction, the backward conveyance path 104 used at the time of duplex printing is defined between the maintenance door 19 and the cover member 20 while ensuring the beautiful external appearance of the apparatus main body 11 by the maintenance door 19. Thus, the number of parts can be reduced as compared to the case where the special backward conveyance path 104 is provided in the apparatus main body 11, which can contribute to a cost reduction of the apparatus.

Particularly in the locking mechanism 50' according to the second embodiment, the locking rod 52' includes the locking rod main body 55, the reciprocating rod 56 disposed in the locking rod main body 55 in such a manner as to reciprocate and the small-diameter coil spring 57 for biasing the reciprocating rod 56 toward the conveyance unit 30. The leading end of the reciprocating rod 56 is formed with such a guiding inclined surface 564 as to be able to temporarily move back upon interfering with the conveyance unit 30 being pushed into the apparatus main body 11 and then advance by the biasing force of the small-diameter coil spring 57 with the cover member 20 closed.

According to such a construction, even if the cover member 20 is closed before the conveyance unit 30 is pushed into the apparatus main body 11, the guiding inclined surface 564 at the leading end of the reciprocating rod 56 interferes with the conveyance unit 30 as the conveyance unit 30 is pushed into the apparatus main body 11, whereby the reciprocating rod 56 moves back against the biasing force of the small-diameter coil spring 57. Thus, the conveyance unit 30 can be pushed into the apparatus main body 11 without being hindered by the locking rod 52'.

Thus, concerning an order of the closing operation of the opened cover member 20 and the pushing operation of the pulled-out conveyance unit 30 at the time of a maintenance operation, it is no longer necessary to force the user to close the cover member 20 after the conveyance unit 30 is first pushed. Therefore, a degree of freedom of these operations increases and the operability of the maintenance operation can be improved.

The present invention is not limited to the above embodiments and embraces the following contents.

(1) In the above embodiments, the copier is taken as an example of the image forming apparatus 10. The present invention is also applicable to other image forming apparatuses such as printers and facsimile machines.

(2) In the above embodiments, the intermediate unit 40 is provided between the cover member 20 and the conveyance unit 30. The intermediate unit 40 is not essential and may not be provided. In the case of providing no intermediate unit 40, the downstream end of the conveyance-unit conveyance path 34 formed in the conveyance unit 30 may be formed to have an upward concave shape so as to smoothly meet the vertical sheet conveyance path 101.

(3) In the above embodiments, only sheets P from the manual feed tray 18 are introduced to the conveyance unit 30. If a sheet P from the sheet cassette 141 is dispensed from the right end of the sheet cassette 141 contrary to the construction shown in FIG. 2, the sheet P from the sheet cassette 141 may be conveyed to the image forming assembly 12 via the conveyance unit 30.

(4) In the above embodiments, the locking rod 52, 52' of the locking mechanism 50, 50' is biased toward the cover member 20 by the biasing force of the coil spring 54, 54'. Instead, the side plate 22 of the cover member 20 and the left end of the locking rod 52, 52' may be relatively rotatably linked via a pin provided on the side plate 22 without using the coil spring 54, 54'. This enables the locking rod 52, 52' to follow the opening and closing movements of the conveyance unit 30 without particularly using the coil spring 54, 54'. Since the coil spring 54, 54' needs not be provided, a reduction in the number of parts can be realized to contribute to a cost reduction of the apparatus.

The specific embodiments described above mainly embrace inventions having the following constructions.

An image forming apparatus according to one aspect of the present invention comprises an apparatus main body; an image forming assembly arranged in the apparatus main body for transferring a toner image formed based on image information to a sheet; a sheet tray on which a sheet to be subjected to an image transfer process is to be placed; a conveyance unit detachably insertable into the apparatus main body, provided between the sheet tray and the image forming assembly and adapted to convey the sheet on the sheet tray toward the image forming assembly; an openable and closable cover member provided on a wall of the apparatus main body facing a downstream end of the conveyance unit in a sheet conveying direction; a vertical conveyance path defined at an inner side of the cover member by closing the cover member for further conveying the sheet conveyed by the conveyance unit upward; and a locking mechanism for preventing the conveyance unit from being pulled out from the apparatus main body with the cover member closed.

According to this construction, since the conveyance unit is prevented from being pulled out from the apparatus main body by the locking mechanism with the cover member closed, there is no likelihood that the conveyance unit is pulled out from the apparatus main body with a sheet present between the vertical conveyance path at the inner side of the cover member and the conveyance unit. Accordingly, the tear of a jammed sheet caused by pulling the conveyance unit out with the sheet jammed can be prevented and an occurrence of such a problem as to make a jam processing difficult can be prevented. Further, a user can be let to notice that the cover member has to be opened upon an occurrence of a paper jam since the conveyance unit cannot be pulled out, thereby contributing to an improvement in the operability of a jam removal.

In the above construction, it is preferable that the locking mechanism includes a locking rod that operates as the cover member is opened and closed; and that the locking rod interferes with the conveyance unit with the cover member closed and does not interfere with the conveyance unit with the cover member opened.

In this construction, with the cover member closed, the locking rod interferes with the conveyance unit and the conveyance unit cannot be pulled out from the apparatus main body. Thus, there is no likelihood that the conveyance unit is inadvertently pulled out from the apparatus main body despite the cover member being closed. On the other hand, since the locking rod does not interfere with the conveyance unit with the cover member opened, the conveyance unit can be pulled out from the apparatus main body.

In the above construction, it is preferable that the locking rod is arranged between the cover member and the conveyance unit and includes a first end located at a side toward the cover member, a second end located at a side toward the conveyance unit and a biasing member for biasing the locking rod in a direction toward the first end; the cover member has a contact surface that can be brought into contact with the first end; the conveyance unit includes a groove portion into which the second end is fittable; and the contact surface pushes the first end to move the locking rod in a direction toward the second end against a biasing force of the biasing member, thereby fitting the second end into the groove portion, with the cover member closed, whereas the locking rod is moved in the direction toward the first end by the biasing force of the biasing member to bring the second end out of the groove portion with the cover member opened.

In the above construction, the locking rod may be arranged between the cover member and the conveyance unit and include a locking rod main body arranged at a side toward the cover member, a reciprocating rod arranged at a side toward the conveyance unit and engaged with the locking rod main body in such a manner as to reciprocate and a biasing member for biasing the reciprocating rod toward the conveyance unit. In this case, a guiding inclined surface to be pushed by the conveyance unit when the pulled-out conveyance unit is mounted into the apparatus main body is preferably formed at the leading end of the reciprocating rod.

According to this construction, even if the cover member is closed before the conveyance unit is pushed into the apparatus main body, the guiding inclined surface at the leading end of the reciprocating rod biased toward the conveyance unit relatively comes to be pushed by the conveyance unit as the conveyance unit is pushed into the apparatus main body. Since the reciprocating rod is moved backward against the biasing force of the biasing member in this way, the conveyance unit can be pushed into the apparatus main body without being hindered by the locking rod. Thereafter, the conveyance unit is locked by the locking rod moved forward by the biasing force of the biasing member.

Accordingly, concerning an order of the closing operation of the opened cover member and the pushing operation of the pulled-out conveyance unit at the time of a maintenance operation, it is no longer necessary to force the user to close the cover member after the conveyance unit is first pushed. Therefore, a degree of freedom of these operations increases and the operability of the maintenance operation can be improved.

In the above construction, it is preferable that an openable and closable decorative door arranged in the apparatus main body and facing the cover member is further provided; and that a backward conveyance path for conveying a sheet in a reverse direction at the time of duplex printing is defined between the decorative door and the cover member.

According to this construction, the backward conveyance path used at the time of duplex printing is defined between the decorative door and the cover member while ensuring the beautiful external appearance of the apparatus main body by the decorative door. Thus, the number of parts can be reduced as compared to the case where a special backward conveyance path is provided in the apparatus main body, which can contribute to a cost reduction of the apparatus.

In the above construction, it is preferable that the sheet tray is a manual feed tray arranged at one side surface of the apparatus main body; and the conveyance unit conveys a sheet fed from the manual feed tray in a horizontal direction toward the vertical conveyance path.

In this case, it is preferable that an intermediate unit is further provided between the conveyance unit and the vertical conveyance path; and that the intermediate unit is fixedly arranged in the apparatus main body and includes a conveyance path curved upward to convey a sheet being conveyed in a horizontal direction in the conveyance unit toward the vertical conveyance path.

An image forming apparatus according to another aspect of the present invention comprises an apparatus main body; an openable and closable cover member provided on one wall of the apparatus main body; an image forming assembly arranged in the apparatus main body for forming an image on a sheet; a sheet feeder for feeding a sheet to have an image formed thereon; a sheet discharging portion to which a sheet after image formation is discharged; a conveyance unit detachably insertable into the apparatus main body; a sheet conveyance path for conveying a sheet from the sheet feeder to the sheet discharging portion via the image forming assembly, the sheet conveyance path extending through the conveyance unit; and a locking rod that operates as the cover member is opened and closed, the locking rod interfering with the conveyance unit with the cover member closed and not interfering with the conveyance unit with the cover member opened.

According to this construction, with the cover member closed, the locking rod and the conveyance unit interfere with each other to prevent the conveyance unit from being pulled out from the apparatus main body. Thus, there is no likelihood that the conveyance unit is pulled out from the apparatus main body without the cover member being opened with a sheet present between the conveyance unit and an other part of the sheet conveyance path.

In this construction, it is preferable that the sheet conveyance path includes a horizontal conveyance path for conveying a sheet in a horizontal direction and a vertical conveyance path arranged downstream of the horizontal conveyance path for conveying the sheet in an upward direction; that the conveyance unit forms a part of the horizontal conveyance path; and that a part of the vertical conveyance path is formed by the inner surface of the cover member.

Further, it is preferable that an intermediate unit arranged at a boundary portion between the horizontal conveyance path and the vertical conveyance path is further provided; and that the intermediate unit is fixedly arranged in the apparatus main body adjacent to a downstream side of the conveyance unit and includes a conveyance path curved upward to convey a sheet being conveyed in the horizontal direction in the conveyance unit toward the vertical conveyance path.

This application is based on patent application Nos. 2007-049050 and 2007-144958 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus, comprising:

an apparatus main body;

an image forming assembly arranged in the apparatus main body for transferring a toner image formed based on image information to a sheet;

a sheet tray on which a sheet to be subjected to an image transfer process is to be placed;

a conveyance unit detachably insertable into the apparatus main body, provided between the sheet tray and the image forming assembly and adapted to convey the sheet on the sheet tray toward the image forming assembly, the conveyance unit having an engaging portion;

an openable and closable cover member provided on a wall of the apparatus main body facing a downstream end of the conveyance unit in a sheet conveying direction, the cover member having a contact surface;

a vertical conveyance path defined at an inner side of the cover member by closing the cover member for further conveying the sheet conveyed by the conveyance unit upward; and a locking mechanism for preventing the conveyance unit from being pulled out from the apparatus main body with the cover member closed, wherein the locking mechanism includes a locking rod that is arranged between the cover member and the conveyance unit and that operates as the cover member is opened and closed, the locking rod including a first end located at a side toward the cover member, a second end located at a side toward the conveyance unit and a first biasing member for biasing the locking rod in a direction toward the first end, wherein the contact surface of the cover member pushes the first end to move the locking rod in a direction toward the second end against a biasing force of the first biasing member, thereby engaging the second end of the locking rod with the engaging portion with the cover member closed, whereas the biasing force of the first biasing member moves the locking rod in the direction toward the first end of the locking rod to release the engagement between the second end with the engaging portion with the cover member opened so that the locking rod interferes with the conveyance unit with the cover member closed and does not interfere with the conveyance unit with the cover member opened.

2. An image forming apparatus according to claim 1, wherein:

the engaging portion is a groove into which the second end is fittable.

3. An image forming apparatus according to claim 1, wherein:

the locking rod includes:

a locking rod main body having the first end and arranged at a side toward the cover member, a reciprocating rod having the second end and arranged at a side toward the conveyance unit and engaged with the locking rod main body in such a manner as to reciprocate, and a second biasing member for biasing the reciprocating rod toward the conveyance unit.

4. An image forming apparatus according to claim 3, wherein a guiding inclined surface to be pushed by the conveyance unit when the pulled-out conveyance unit is mounted into the apparatus main body is formed at the leading end of the reciprocating rod.

5. An image forming apparatus according to claim 1, further comprising:

an openable and closable decorative door provided in the apparatus main body and facing the cover member; and a backward conveyance path defined between the decorative door and the cover member for conveying a sheet in a reverse direction at the time of duplex printing.

6. An image forming apparatus according to claim 1, wherein:

the sheet tray is a manual feed tray arranged at one side surface of the apparatus main body; and the conveyance unit conveys a sheet fed from the manual feed tray in a horizontal direction toward the vertical conveyance path.

7. An image forming apparatus according to claim 6, further comprising an intermediate unit provided between the conveyance unit and the vertical conveyance path; wherein the intermediate unit is fixedly arranged in the apparatus main body and includes a conveyance path curved upward to convey a sheet being conveyed in a horizontal direction in the conveyance unit toward the vertical conveyance path.

8. An image forming apparatus according to claim 1, wherein the wall on which the cover member is provided is a first wall, and wherein the conveyance unit is detachably insertable into the apparatus main body at a second wall that is substantially orthogonal to the first wall.

9. An image forming apparatus according to claim 1, wherein the locking rod is movable in a plane substantially parallel to the sheet conveying direction.

10. An image forming apparatus according to claim 1, wherein the cover member is rotatable about a supporting shaft, the conveyance unit being insertable into the apparatus main body in a direction substantially parallel to the supporting shaft.

11. An image forming apparatus according to claim 10, wherein the locking rod is movable in directions substantially perpendicular to the supporting shaft.

12. An image forming apparatus, comprising:

an apparatus main body;

an openable and closable cover member provided on one wall of the apparatus main body, the cover member having a contact surface;

an image forming assembly arranged in the apparatus main body for forming an image on a sheet;

a sheet feeder for feeding a sheet to have an image formed thereon;

a sheet discharging portion to which a sheet after image formation is discharged;

a conveyance unit detachably insertable into the apparatus main body, the conveyance unit having an engageable portion;

a sheet conveyance path for conveying a sheet from the sheet feeder to the sheet discharging portion via the image forming assembly, the sheet conveyance path extending through the conveyance unit; and a locking rod arranged between the cover member and the conveyance unit and including a first end located at a side toward the cover member and engageable with the contact surface of the cover member, a second end located at a side toward the conveyance unit and engageable with the engageable portion of the conveyance unit and a first biasing member for biasing the locking rod in a direction toward the first end, the contact surface of the cover member pushing the first end to move the locking rod in a direction toward the second end against a biasing force of the first biasing member when the cover member is closed thereby engaging the second end of the locking rod with the engaging portion when the cover member is closed, whereas the biasing force of the first biasing member moves the locking rod in the direction toward the first end to release the engagement between the second end and the engaging portion when the cover member is opened, so that the locking rod operates as the cover member is opened and closed for interfering with the conveyance unit with the cover member closed and not interfering with the conveyance unit with the cover member opened.

13. An image forming apparatus according to claim 12, wherein:

the sheet conveyance path includes a horizontal conveyance path for conveying a sheet in a horizontal direction and a vertical conveyance path arranged downstream of the horizontal conveyance path for conveying the sheet in an upward direction;

the conveyance unit forms a part of the horizontal conveyance path; and a part of the vertical conveyance path is formed by the inner surface of the cover member.

14. An image forming apparatus according to claim 13, further comprising an intermediate unit arranged at a boundary portion between the horizontal conveyance path and the vertical conveyance path; wherein the intermediate unit is fixedly arranged in the apparatus main body adjacent to a downstream side of the conveyance unit and includes a conveyance path curved upward to convey a sheet being conveyed in a horizontal direction in the conveyance unit toward the vertical conveyance path.

15. An image forming apparatus according to claim 13, wherein:

the sheet tray is a manual feed tray arranged at one side surface of the apparatus main body; and the conveyance unit conveys a sheet fed from the manual feed tray in the horizontal direction toward the vertical conveyance path.

16. An image forming apparatus according to claim 12, wherein:

the engaging portion is a groove into which the second end is fittable.

17. An image forming apparatus according to claim 12, wherein:

the locking rod includes:

a locking rod main body having the first end and arranged at the side toward the cover member, a reciprocating rod having the second end and arranged at the side toward the conveyance unit and engaged with the locking rod main body in such a manner as to reciprocate, and a second biasing member for biasing the reciprocating rod toward the conveyance unit; and a guiding inclined surface to be pushed by the conveyance unit when the pulled-out conveyance unit is mounted into the apparatus main body is formed at the leading end of the reciprocating rod.

* * * * *